US009017136B2

(12) United States Patent
Norman et al.

(10) Patent No.: US 9,017,136 B2
(45) **Date of Patent: *Apr. 28, 2015**

(54) VIBRATION POWERED TOY

(75) Inventors: David Anthony Norman, Greenville, TX (US); Robert H. Mimlitch, III, Rowlett, TX (US); Douglas Michael Galletti, Allen, TX (US); Joel Reagan Carter, Argyle, TX (US)

(73) Assignee: Innovation First, Inc., Greenville, TX (US)

( * ) Notice: Subject to any disclaimer, the term of this patent is extended or adjusted under 35 U.S.C. 154(b) by 20 days.

This patent is subject to a terminal disclaimer.

(21) Appl. No.: 12/860,696

(22) Filed: Aug. 20, 2010

(65) Prior Publication Data

US 2011/0076914 A1 Mar. 31, 2011

Related U.S. Application Data

(60) Provisional application No. 61/246,023, filed on Sep. 25, 2009.

(51) Int. Cl.
*A63H 13/00* (2006.01)
*A63H 11/02* (2006.01)
(Continued)

(52) U.S. Cl.
CPC ..... *A63H 11/02* (2013.01); *A63H 17/26* (2013.01); *A63H 29/22* (2013.01)

(58) Field of Classification Search
CPC ..... A63H 11/00; A63H 11/02; A63H 17/004; A63H 33/26
USPC ..... 446/3, 236, 351–356, 377, 484, 486
See application file for complete search history.

(56) References Cited

U.S. PATENT DOCUMENTS 1,544,568 A * 7/1925 Fehr ..... 446/460
1,793,121 A 7/1928 Muller
(Continued)

FOREIGN PATENT DOCUMENTS

CN 1053896 8/1991
CN 2 820 261 9/2006
(Continued)

OTHER PUBLICATIONS

Notification of Transmittal of the International Search Report and the Written Opinion of the International Searching Authority, or Declaration (1 page); International Search Report (7 pages); and Written Opinion of the International Searching Authority (10 pages), mailed Mar. 25, 2011, for related international application PCT/US2010/050257.

(Continued)

*Primary Examiner* — Gene Kim
*Assistant Examiner* — Alyssa Hylinski
(74) *Attorney, Agent, or Firm* — Adam K. Sacharoff; Much Shelist

(57) ABSTRACT

An apparatus includes a housing, a rotational motor situated within the housing, an eccentric load adapted to be rotated by the rotational motor, and a plurality of legs each having a leg base and a leg tip at a distal end relative to the leg base. The legs are coupled to the housing at the leg base and include at least one driving leg constructed from a flexible material and configured to cause the apparatus to move in a direction generally defined by an offset between the leg base and the leg tip as the rotational motor rotates the eccentric load.

81 Claims, 12 Drawing Sheets

(51) Int. Cl.
*A63H 17/26* (2006.01)
*A63H 29/22* (2006.01)

(56) References Cited

U.S. PATENT DOCUMENTS

| | | | | | |
|---|---|---|---|---|---|
| 1,763,788 | A | | 6/1930 | Jobe, Sr. | |
| 2,167,985 | A | | 8/1939 | Levay | |
| 2,618,888 | A | * | 11/1952 | Hoff | 446/3 |
| 2,827,735 | A | | 3/1958 | Grimm | |
| 2,862,333 | A | | 12/1958 | Franco | |
| 2,919,921 | A | | 1/1960 | Berger | |
| 3,196,580 | A | * | 7/1965 | Rakestraw | 446/484 |
| 3,331,463 | A | | 7/1967 | Kramer | |
| 3,343,793 | A | | 9/1967 | Waser | |
| 3,530,617 | A | | 9/1970 | Halvorson et al. | |
| 3,712,541 | A | | 1/1973 | Merino et al. | |
| 3,841,636 | A | * | 10/1974 | Meyer | 273/110 |
| 3,842,532 | A | | 10/1974 | Nielsen | |
| 3,959,920 | A | | 6/1976 | Ieda | |
| 4,163,558 | A | | 8/1979 | Breslow et al. | |
| 4,183,173 | A | | 1/1980 | Ogawa | |
| 4,195,703 | A | * | 4/1980 | Hawkins | 180/7.1 |
| 4,219,957 | A | * | 9/1980 | Kakuta | 446/230 |
| 4,291,490 | A | * | 9/1981 | Ikeda | 446/90 |
| 4,496,100 | A | | 1/1985 | Schwager et al. | |
| 4,544,094 | A | | 10/1985 | Scholey | |
| 4,550,910 | A | | 11/1985 | Goldfarb et al. | |
| 4,591,346 | A | * | 5/1986 | Ikeda | 446/437 |
| 4,605,230 | A | | 8/1986 | Halford et al. | |
| 4,674,949 | A | | 6/1987 | Kroczynski | |
| 4,708,690 | A | | 11/1987 | Kulesza et al. | |
| 4,824,415 | A | | 4/1989 | Herbstler et al. | |
| 4,941,857 | A | | 7/1990 | Fujimaki | |
| 5,088,949 | A | | 2/1992 | Atkinson et al. | |
| 5,221,226 | A | | 6/1993 | Park | |
| 5,679,047 | A | * | 10/1997 | Engel | 446/3 |
| 5,947,788 | A | | 9/1999 | Derrah | |
| 5,993,286 | A | * | 11/1999 | Tacquard et al. | 446/351 |
| 6,155,905 | A | | 12/2000 | Truax | |
| 6,199,439 | B1 | | 3/2001 | Lin | |
| 6,238,264 | B1 | | 5/2001 | Kazami et al. | |
| D458,320 | S | | 6/2002 | Domingues | |
| 6,435,929 | B1 | | 8/2002 | Halford | |
| 6,450,104 | B1 | | 9/2002 | Grant et al. | |
| 6,547,630 | B2 | | 4/2003 | Beaman | |
| 6,599,048 | B2 | | 7/2003 | Kuo | |
| 6,652,352 | B1 | | 11/2003 | MacArthur et al. | |
| 6,826,449 | B1 | * | 11/2004 | Abu-Taha | 700/245 |
| 6,866,557 | B2 | | 3/2005 | Randall | |
| 6,899,589 | B1 | * | 5/2005 | Lund et al. | 446/351 |
| 6,964,572 | B2 | | 11/2005 | Cesa | |
| 7,025,656 | B2 | | 4/2006 | Bailey | |
| 7,040,951 | B2 | | 5/2006 | Hornsby et al. | |
| 7,339,340 | B2 | | 3/2008 | Summer et al. | |
| 7,803,031 | B1 | | 9/2010 | Winckler et al. | |
| 7,927,170 | B2 | * | 4/2011 | Bickerton et al. | 446/3 |
| 8,038,503 | B2 | * | 10/2011 | Norman et al. | 446/351 |
| 8,083,503 | B2 | * | 12/2011 | Voltenburg et al. | 417/477.11 |
| 8,834,227 | B2 | * | 9/2014 | Norman et al. | 446/353 |
| 8,905,813 | B2 | * | 12/2014 | Norman et al. | 446/351 |
| 2001/0024925 | A1 | * | 9/2001 | Domingues | 446/353 |
| 2001/0054518 | A1 | | 12/2001 | Buehler et al. | |
| 2004/0198159 | A1 | | 10/2004 | Xu et al. | |
| 2005/0112992 | A1 | | 5/2005 | Malcolm | |
| 2006/0076735 | A1 | | 4/2006 | Proch et al. | |
| 2007/0087654 | A1 | | 4/2007 | Chernick et al. | |
| 2008/0061644 | A1 | | 3/2008 | Treat | |
| 2009/0311941 | A1 | | 12/2009 | Bickerton et al. | |
| 2012/0100777 | A1 | | 4/2012 | Hsu | |

FOREIGN PATENT DOCUMENTS

| | | | | |
|---|---|---|---|---|
| DE | 916 935 | | | 8/1954 |
| DE | 11 20 958 | | | 12/1961 |
| EP | 0008676 | | | 3/1980 |
| FR | 1564711 | | | 4/1969 |
| FR | 2 348 723 | | | 11/1977 |
| FR | 2358174 | | | 2/1978 |
| GB | 488042 | A | | 6/1938 |
| GB | 1180384 | A | * | 2/1970 |
| GB | 1 291 592 | | | 10/1972 |
| GB | 1 381 326 | | | 1/1975 |
| GB | 1 595 007 | | | 8/1981 |
| GB | 2427529 | | | 12/2006 |
| GB | 2427529 | A | * | 12/2006 |
| JP | 1146570 | A | | 6/1989 |
| JP | 04030883 | | | 2/1992 |
| JP | 6343767 | | | 12/1994 |
| JP | 06343767 | A | * | 12/1994 |
| KR | 20070101487 | | | 10/2007 |
| WO | WO03/015891 | | | 12/2003 |
| WO | 2006/136792 | A1 | | 12/2006 |
| WO | WO 2011/038280 | | | 3/2011 |
| WO | WO 2011/038281 | | | 3/2011 |

OTHER PUBLICATIONS

Search Report dated Sep. 20, 2011 in corresponding German application No. 102010046513.5, 5 pages.
Search Report dated Sep. 20, 2011 in corresponding German application No. 102010046511.9, 5 pages.
Search Report dated Sep. 20, 2011 in corresponding German application No. 102010046509.7, 5 pages.
Search Report dated Sep. 20, 2011 in corresponding German application No. 102010046440.6, 5 pages.
Search Report dated Sep. 20, 2011 in corresponding German application No. 102010046510.0, 5 pages.
Search Report dated Sep. 20, 2011 in corresponding German application No. 102010046441.4, 5 pages.
RC Bristlebot, http://blog.makezine.com/archive/2008/04/rc_bristlebot.html, Aug. 30, 2010.
Publisher Klutz Lives Up to Its Name: "Bristlebots," Scholastic, and Evil Mad Scientist Lab http://boingboing.net/2009/02/20/publisher-klutz-live.html, Xeni Jardin at 9:06 am, Feb. 20, 2009.
Vibrobot, "Make a Twitchy, Bug-Like Robot with a Toy Motor and a Mint Tin" http://makezine.com/10/123_vibrobot/, 2007.
Vibrobot, "How To—Make a Bristlebot a Tiny Directional Vibrobot Made from a Toothbrush!" , http://blog.makezine.com/archive/2007/12/how_to_make_a_bristlebot.html, 2007.
BotJunkie,DIY Vibrobots, http://www.botjunkie.com/2007/12/20/diy-vibrobots/, 2007.
Notification of Transmittal of the International Search Report and the Written Opinion of the International Searching Authority, or Declaration (1 page); International Search Report (2 pages); and Written Opinion of the International Searching Authority (29 pages), mailed Nov. 22, 2010, for related international application PCT/US2010/050238.
David Anthony Norman et al., "Vibration Powered Toy" Office Action dated Oct. 28, 2010 in corresponding Australian application No. 2010224405.
http://www.evilmadscientist.com/article.php/bristlebot, Oskay, Dec. 19, 2007.
http://www.youtube.com/watch?v=h6jowo3OxAO, Innovation First, Sep. 18, 2009.
http://www.klutz.com/Invasion-of-the-Bristlebots, [online] Invasion of the Bristlebots, 8 pages, [retrieved Oct. 20, 2010].
http://www.streettech.com/modules, [online] How-To: Build BEAM Vibrobots, Street Tech, Hardware beyond the hype, 7 pages [Retrieved Oct. 20, 2010].
http://www.evilmadscientist/.com/article.php/bristlebot, [online] Bristlebot: A tiny directional vibrobot—Evil Mad Scientist Laboratories, 21 pages, [Retrieved Oct. 20, 2010].
http://themombuzz.mom/2009/12/11/stocking-stuffer-nascar-zipbot-race-set [on line] Stocking Stuffer: NASCARr Zipbot Race Set: The Mom Buzz, 10 pages, [Retrieved Oct. 20, 2010].
Notification of Transmittal of the International Search Report and the Written Opinion of the International Searching Authority, or Declaration (1 page); International Search Report (4 pages); and Written

(56) References Cited

OTHER PUBLICATIONS

Opinion of the International Searching Authority (6 pages), mailed Feb. 14, 2011, for related international application PCT/US2010/050261.
Notification of Transmittal of the International Search Report and the Written Opinion of the International Searching Authority, or Declaration (1 page); International Search Report (4 pages); and Written Opinion of the International Searching Authority (6 pages), mailed Feb. 15, 2011, for related international application PCT/US2010/050265.
Notification of Transmittal of the International Search Report and the Written Opinion of the International Searching Authority, or Declaration (1 page); International Search Report (4 pages); and Written Opinion of the International Searching Authority (6 pages), mailed Feb. 3, 2011, for related international application PCT/US2010/050258.
Notification of Transmittal of the International Search Report and the Written Opinion of the International Searching Authority, or Declaration (1 page); International Search Report (4 pages); and Written Opinion of the International Searching Authority (7 pages), mailed Feb. 3, 2011, for related international application PCT/US2010/050281.
Notification of Transmittal of the International Search Report and the Written Opinion of the International Searching Authority, or Declaration (1 page); International Search Report (4 pages); and Written Opinion of the International Searching Authority (6 pages), mailed Feb. 3, 2011, for related international application PCT/US2010/050266.
Notification of Transmittal of the International Search Report and the Written Opinion of the International Searching Authority, or Declaration (1 page); International Search Report (5 pages); and Written Opinion of the International Searching Authority (6 pages), mailed Jan. 26, 2011, for related international application PCT/US2010/050256.
David Anthony Norman et al., "Vehicle, in Particular, a Toy Robot with Vibrating Motor" EPO Search Report dated Jan. 27, 2011 in corresponding European application No. 10179680.3, 3 pages.
David Anthony Norman et al., "Vehicle, in Particular, a Toy Robot with Vibrating Motor" EPO Communication dated Feb. 10, 2011 in corresponding European application No. 10179680.3, 5 pages.
David Anthony Norman et al., "Vehicle, in Particular, a Toy Robot with Vibrating Motor" EPO Search Report dated Feb. 3, 2011 in corresponding European application No. 10179686.0, 3 pages.
David Anthony Norman et al., "Vehicle, in Particular, a Toy Robot with Vibrating Motor" EPO Search Report dated Feb. 3, 2011 in corresponding European application No. 10179694.4, 3 pages.
David Anthony Norman et al., "Vehicle, in Particular, a Toy Robot with Vibrating Motor" EPO Search Report dated Feb. 3, 2011 in corresponding European application No. 10179701.7 , 3 pages.
David Anthony Norman et al., "Vehicle, in Particular, a Toy Robot with Vibrating Motor" EPO Search Report dated Feb. 3, 2011 in corresponding European application No. 10179706.6 , 3 pages.
David Anthony Norman et al., "Vehicle, in Particular, a Toy Robot with Vibrating Motor" EPO Search Report dated Feb. 15, 2011 in corresponding European application No. 10179707.4 , 3 pages.
EPO Office Communication dated Mar. 31, 2011 in corresponding European application No. 10179686.0, 5 pages.
EPO Office Communication dated Mar. 31, 2011 in corresponding European application No. 10179694.4, 5 pages.
EPO Office Communication dated Mar. 31, 2011 in corresponding European application No. 10179701.7 , 5 pages.
EPO Office Communication dated Mar. 31, 2011 in corresponding European application No. 10179706.6 , 4 pages.
EPO Office Communication dated Mar. 31, 2011 in corresponding European application No. 10179707.4 , 4 pages.
Notification of Transmittal of the International Search Report and the Written Opinion of the International Searching Authority, or Declaration (1 page); International Search Report (7 pages); and Written Opinion of the International Searching Authority (10 pages), mailed Apr. 14, 2011, for related international application PCT/US2010/050279.
Search Report dated Jul. 5, 2012 in corresponding European application No. 12163857.1, 3 pages.
Office Action issued in U.S. Appl. No. 12/872,850 on Nov. 26, 2012, 15 pages.
Office Action issued in U.S. Appl. No. 13/433,758 on Feb. 21, 2013, 17 pages.
Office Action dated Feb. 5, 2013 in corresponding Chinese Application No. 201080001432.4, 25 pages.
EPO Office Communication dated Jul. 23, 2012 in corresponding European application No. 12163857.1, 5 pages.
EPO Office Communication dated Jul. 23, 2012 in corresponding European application No. 12166840.4, 3 pages.
Notification of Transmittal of the International Search Report and the Written Opinion of the International Searching Authority, or Declaration (1 page); International Search Report (4 pages); and Written Opinion of the International Searching Authority (5 pages), mailed Jun. 7, 2012, for related international application PCT/US2012/027914.
Office Action dated Jul. 16, 2012 in corresponding Australian application No. 2012201317, 3 pages.
Office Action dated Aug. 3, 2012 in corresponding Chinese application No. 201080001431.X, 18 pages.
GreenbergTraurig Letter dated Aug. 10, 2012 (2 pages).
*Innovation First, Inc., and Innovation First Labs, Inc.* v. *Toy Investment, Inc. D/B/A Toysmith, and McManemin Companies*, Civil Action No. 3:12-CV-02091-M, Plaintiffs' Answer to Defendants' Counterclaims, Filed Sep. 13, 2012 (5 pages).
*Innovation First, Inc., and Innovation First Labs, Inc.* v. *Toy Investment, Inc. D/B/A Toysmith, and McManemin Companies*, Civil Action No. 3:12-CV-02091-M, Answer to Complaint, Filed Aug. 20, 2012 (7 pages).
*Innovation First, Inc., and Innovation First Labs, Inc.* v. *Toy Investment, Inc. D/B/A Toysmith, and McManemin Companies*, Civil Action No. 3:12-CV-02091-M, Plaintiffs' Complaint for Patent Infringement, Filed Jun. 29, 2012 (45 pages).
Davis Wright Tremaine LLP Letter dated Aug. 1, 2012 (3 pages).
Notice of Allowance for copending U.S. Appl. No. 13/245,475; Jun. 10, 2014.
Office Action dated Feb. 8, 2013 in corresponding European Application No. 12163857.1, 8 pages.

* cited by examiner

VIBRATION POWERED TOY

CROSS-REFERENCE TO RELATED APPLICATIONS

This application claims the benefit under 35 U.S.C. §119 (e) of U.S. Patent Application No. 61/246,023, entitled "Vibration Powered Vehicle," filed Sep. 25, 2009, which is incorporated herein by reference in its entirety.

BACKGROUND

This specification relates to devices that move based on oscillatory motion and/or vibration.

One example of vibration driven movement is a vibrating electric football game. A vibrating horizontal metal surface induced inanimate plastic figures to move randomly or slightly directionally. More recent examples of vibration driven motion use internal power sources and a vibrating mechanism located on a vehicle.

One method of creating movement-inducing vibrations is to use rotational motors that spin a shaft attached to a counterweight. The rotation of the counterweight induces an oscillatory motion. Power sources include wind up springs that are manually powered or DC electric motors. The most recent trend is to use pager motors designed to vibrate a pager or cell phone in silent mode. Vibrobots and Bristlebots are two modern examples of vehicles that use vibration to induce movement. For example, small, robotic devices, such as Vibrobots and Bristlebots, can use motors with counterweights to create vibrations. The robots' legs are generally metal wires or stiff plastic bristles. The vibration causes the entire robot to vibrate up and down as well as rotate. These robotic devices tend to drift and rotate because no significant directional control is achieved.

Vibrobots tend to use long metal wire legs. The shape and size of these vehicles vary widely and typically range from short 2" devices to tall 10" devices. Rubber feet are often added to the legs to avoid damaging tabletops and to alter the friction coefficient. Vibrobots typically have 3 or 4 legs, although designs with 10-20 exist. The vibration of the body and legs creates a motion pattern that is mostly random in direction and in rotation. Collision with walls does not result in a new direction and the result is that the wall only limits motion in that direction. The appearance of lifelike motion is very low due to the highly random motion.

Bristlebots are sometimes described in the literature as tiny directional Vibrobots. Bristlebots use hundreds of short nylon bristles for legs. The most common source of the bristles, and the vehicle body, is to use the entire head of a toothbrush. A pager motor and battery complete the typical design. Motion can be random and directionless depending on the motor and body orientation and bristle direction. Designs that use bristles angled to the rear with an attached rotating motor can achieve a general forward direction with varying amounts of turning and sideways drifting. Collisions with objects such as walls cause the vehicle to stop, then turn left or right and continue on in a general forward direction. The appearance of lifelike motion is minimal due to a gliding movement and a zombie-like reaction to hitting a wall.

SUMMARY

In general, one innovative aspect of the subject matter described in this specification can be embodied in apparatus that include a housing, a rotational motor situated within the housing, an eccentric load adapted to be rotated by the eccentric load, and a plurality of legs. Each leg includes a leg base and a leg tip at a distal end relative to the leg base. The legs are coupled to the housing at the leg base and include at least one driving leg constructed from a flexible material and configured to cause the apparatus to move in a direction generally defined by an offset between the leg base and the leg tip as the rotational motor rotates the eccentric load. At least one leg is adapted to drag.

These and other embodiments can each optionally include one or more of the following features. The apparatus includes fewer than twenty legs that contact a support surface as the at least one driving leg causes the apparatus to move. The apparatus includes fewer than twenty legs that provide support when the apparatus is in an upright position. The legs are sufficiently stiff that four or fewer legs are capable of supporting the apparatus without substantial deformation when the apparatus is in an upright position. A coefficient of friction of a portion of legs that contact a support surface is sufficient to substantially eliminate drifting in a lateral direction (i.e., substantially perpendicular to the direction of movement). The legs are molded from a elastomer. The legs are co-molded with at least a portion of the body. The legs are injection molded. Multiple legs are molded simultaneously. Multiple legs and at least a portion of the body are simultaneously integrally injection molded from an elastomer. Multiple legs are co-molded with a portion of the housing, wherein the portion of the housing includes a nose section. The legs are tapered. The housing includes at least a nose and two lateral sides and each leg is coupled to the housing in a vicinity of one of the lateral sides. A diameter of each driving leg is at least 5% of the length of the leg. The legs are curved. The legs are constructed from an elastomeric material. The flexible material includes rubber. The flexible material includes an elastomer. The at least one driving leg is configured to cause the apparatus to repeatedly hop as the rotational motor rotates the eccentric load. The at least one driving leg is curved between the leg base and the leg tip. The eccentric load is configured to be located toward a front end of the apparatus relative to the driving legs, wherein the front end of the apparatus is defined by an end in the direction of movement. The repeated hopping causes the apparatus to move in the direction generally defined by an offset between the leg base and the leg tip. The legs include at least two legs adapted to cause the apparatus to move. The leg tip of the at least one leg adapted to drag has a lower coefficient of friction than the at least one driving leg. The at least one leg that is adapted to drag is configured to have a lesser stiffness than the at least one driving leg. The at least one driving leg includes a durometer in the range of approximately 55-75, based on the Shore A scale. The eccentric load includes an inertial load adapted, when the eccentric load is rotated by the rotational motor, to cause the at least one driving leg to hop off a flat support surface. The plurality of legs are adapted to allow the apparatus to turn when the at least one driving leg hops off a flat support surface. The at least one driving leg is constructed from polystyrene-butadiene-styrene. The at least one driving leg has a ratio of a leg length to a leg diameter in the range of 2.0 to 10.0. The thickness of the legs is defined by a diameter of approximately 5.25 times less than the length of the leg. A curvature of the legs is adapted to enhance a tendency of the apparatus to move in the direction generally defined by the offset between the leg base and the leg tip. The curvature of the legs in combination with a resiliency of the legs are adapted to allow the legs to maintain an approximately neutral position when the rotational motor is not rotating the eccentric load and to bend in a direction of the curvature when a rotational movement of the eccentric load introduces a downward force on the apparatus. The neutral position is defined by a shape of the legs when not supporting a load. At least one driving leg has a ratio of radius of curvature to leg length in a range of 2.5 to 20. The curvature of the legs is approximately consistent from the leg base to the leg tip. The curvature of the legs is defined by a radius of curvature of approximately 3 to 6 times the length of the leg. A relative stiffness of at least two specific legs of the plurality of legs is configured to alter a tendency of the apparatus to turn. The plurality of legs are arranged in two rows, with each row having at least two legs, the leg base of the legs in each row being aligned along each lateral side of the housing. The plurality of legs are arranged in two rows, with each row having at least four legs, the leg base of the legs in each row being aligned along each lateral side of the housing. The plurality of legs are arranged in two rows, with each row having at least six legs, the leg base of the legs in each row being aligned along each lateral side of the housing. At least one of the legs in a first one of the rows is longitudinally offset from a corresponding leg in a second one of the rows to alter a tendency of the apparatus to turn as a result of a rotation of the eccentric load. A lateral distance between the eccentric load and the leg tip of the at least one driving leg is within a range of 50-150% of a length of the at least one driving leg.

In general, another aspect of the subject matter described in this specification can be embodied in apparatus that include a housing, a rotational motor situated within the housing, an eccentric load adapted to be rotated by the rotational motor, and a plurality of legs each having a leg base and a leg tip at a distal end relative to the leg base. The legs are constructed from a flexible material, integrally coupled to the housing at the leg base, arranged in two rows with the leg base of the legs in each row coupled to the housing substantially along a lateral edge of the housing, and include at least one driving leg configured to cause the apparatus to move in a direction generally defined by an offset between the leg base and the leg tip as the rotational motor rotates the eccentric load.

These and other embodiments can each optionally include one or more of the following features. At least one leg is adapted to drag. As stated above, the flexible material can include an elastomer and can be rubber.

In general, another aspect of the subject matter described in this specification can be embodied in apparatus that include a housing, a rotational motor situated within the housing, an eccentric load adapted to be rotated by the rotational motor, and a plurality of legs each having a leg base and a leg tip at a distal end relative to the leg base. The legs are coupled to the housing at the leg base and include at least one driving leg configured to cause the apparatus to move in a direction generally defined by an offset between the leg base and the leg tip as the rotational motor rotates the eccentric load. A relative stiffness of at least two specific legs of the plurality of legs is configured to alter a tendency of the apparatus to turn.

In general, another aspect of the subject matter described in this specification can be embodied in apparatus that include a housing, a rotational motor situated within the housing, an eccentric load adapted to be rotated by the rotational motor, and a plurality of legs each having a leg base and a leg tip at a distal end relative to the leg base. The legs are coupled to the housing at the leg base and include at least one driving leg configured to cause the apparatus to move in a direction generally defined by an offset between the leg base and the leg tip as the rotational motor rotates the eccentric load. A relative position of at least two specific legs of the plurality of legs is configured to alter a tendency of the apparatus to turn.

In general, another aspect of the subject matter described in this specification can be embodied in apparatus that include a housing, a rotational motor situated within the housing, an eccentric load adapted to be rotated by the rotational motor, and a plurality of legs each having a leg base and a leg tip at a distal end relative to the leg base. At least one leg is situated on a first lateral side of the apparatus and at least one leg is situated on a second lateral side of the apparatus. The legs are coupled to the housing at the leg base and include at least one driving leg configured to cause the apparatus to move in a direction generally defined by an offset between the leg base and the leg tip as the rotational motor rotates the eccentric load. A distance between a plane defined by the leg tips and a longitudinal center of gravity of the apparatus is less than a distance between a leg tip of the at least one leg on the first lateral side of the apparatus and a leg tip of the at least one leg on the second lateral side of the apparatus.

These and other embodiments can each optionally include one or more of the following features. At least a portion of the rotational motor is located between at least a portion of at least two of the legs. The apparatus includes a switch for controlling the rotational motor wherein at least a portion of the switch is located between at least a portion of each of at least two of the legs. The apparatus includes a battery for powering the rotational motor wherein at least a portion of the battery is located between at least a portion of at least two of the legs.

In general, another aspect of the subject matter described in this specification can be embodied in apparatus that include a housing, a rotational motor situated within the housing, an eccentric load adapted to be rotated by the rotational motor, and a plurality of legs each having a leg base and a leg tip at a distal end relative to the leg base. The legs are coupled to the housing at the leg base and include at least one driving leg configured to cause the apparatus to move in a direction generally defined by an offset between the leg base and the leg tip as the rotational motor rotates the eccentric load. The axis of rotation of the rotational motor passes approximately through a center of gravity of the apparatus.

These and other embodiments can each optionally include one or more of the following features. The axis of rotation passes within 20% of the center of gravity of the apparatus as a percentage of the height of the apparatus. The axis of rotation passes within about 6% of the center of gravity of the apparatus as a percentage of the height of the apparatus. The axis of rotation of the rotational motor passes sufficiently close to the center of gravity of the apparatus to induce a substantially constant tendency for the apparatus to roll about the longitudinal center of gravity. The housing is configured to facilitate rolling of the apparatus about the longitudinal center of gravity, based on a rotation of the eccentric load, when apparatus is on a substantially flat surface with the legs oriented in an upward direction. The apparatus is configured to prevent the apparatus from resting in an inverted position on the substantially flat surface, wherein the inverted position is defined by the apparatus being in a position where the legs point in substantially an opposite direction from when the legs rest on the substantially flat surface. The housing includes a shoulder on each lateral side and a top side that includes a protruding surface that extends above the shoulder on each lateral side when the apparatus is in an upright position. A distance between the substantially flat surface and the longitudinal center of gravity is approximately the same as a distance between the protruding surface and the longitudinal center of gravity. The distance between the center of gravity and the substantially flat surface is in a range of 50-80% of the value of a lateral stance, wherein the lateral stance is defined by a distance between outermost left and right legs. A lateral distance between the eccentric load and the leg tip of the at least one driving leg is within a range of 50-150% of a length of the at least one driving leg.

In general, another aspect of the subject matter described in this specification can be embodied in apparatus that include a housing, a rotational motor situated within the housing, an eccentric load adapted to be rotated by the rotational motor, and a plurality of legs each having a leg base and a leg tip at a distal end relative to the leg base. The housing includes a top side and a bottom side. The top side includes a shoulder on each lateral side of the housing and a protruding surface extending above each shoulder when the apparatus is oriented with the top side facing up. The rotational motor includes an axis of rotation. The legs extend from the bottom side of the housing and are coupled to the housing at the leg base. The legs include at least one driving leg configured to cause the apparatus to move in a direction generally defined by an offset between the leg base and the leg tip as the rotational motor rotates the eccentric load. A center of gravity of the apparatus is within a range of 40-60% of the distance between a plane that passes through the leg tips of the plurality of legs and the protruding surface on the top side of the housing.

These and other embodiments can each optionally include one or more of the following features. The leg base for each of the plurality of legs is above the center of gravity of the apparatus when the apparatus is oriented with the top side facing up. The axis of rotation of the rotational motor passes within approximately 6% of a center of gravity of the apparatus as a percentage of the height of the apparatus.

In general, another aspect of the subject matter described in this specification can be embodied in apparatus that include a housing, a rotational motor situated within the housing, an eccentric load adapted to be rotated by the rotational motor, and a plurality of legs each having a leg base and a leg tip at a distal end relative to the leg base. The housing includes a front end, rear end, top side, bottom side, and lateral sides. The front end includes a nose adapted to contact obstacles as the apparatus moves in a forward direction and to have increased deformable resilience relative to the lateral sides of the housing. The rotational motor includes an axis of rotation. The legs are coupled to the housing at the leg base and include at least one driving leg configured to cause the apparatus to move in a direction generally defined by an offset between the leg base and the leg tip as the rotational motor rotates the eccentric load.

These and other embodiments can each optionally include one or more of the following features. The nose is further adapted to cause the apparatus to deflect off of obstacles at an angle as the apparatus moves in a forward direction. The nose includes a first surface extending toward a first lateral side of the nose and a second surface extending toward a second lateral side of the nose, wherein each of the first surface and the second surface are angled away from a forward direction of motion as the first surface and the second surface extend toward the lateral sides of the nose. The first surface and the second surface substantially meet at a point at approximately a centerline of the nose.

In general, another aspect of the subject matter described in this specification can be embodied in apparatus that include a housing, a rotational motor situated within the housing, an eccentric load adapted to be rotated by the rotational motor, and a plurality of legs each having a leg base and a leg tip at a distal end relative to the leg base. The legs are coupled to the housing at the leg base and include at least one driving leg configured to cause the apparatus to move in a forward direction generally defined by an offset between the leg base and the leg tip as the rotational motor rotates the eccentric load. Forces from rotation of the eccentric load interact with a resilient characteristic of the at least one driving leg to cause the at least one driving leg to leave a supporting surface as the apparatus translates in the forward direction.

These and other embodiments can each optionally include one or more of the following features. Translation in the forward direction results from a bending of the at least one driving leg in a direction generally opposite the forward direction that is induced at least in part by the rotation of the eccentric load. A coefficient of friction of a portion of at least a subset of the legs that contact a support surface is sufficient to substantially eliminate drifting in a lateral direction. Legs from at least a subset of the plurality of legs are constructed from an elastomeric material. Legs from at least a subset of the plurality of legs are molded from a moldable material. Legs from at least a subset of the plurality of legs are substantially simultaneously integrally injection molded from the moldable material. The moldable material includes an elastomer. The legs that are substantially simultaneously integrally injection molded from the moldable material are co-molded with at least a portion of the housing. Forces from rotation of the eccentric load interact with the resilient characteristic of the at least one driving leg to cause the plurality of legs to leave the supporting surface as the apparatus translates in the forward direction. Forces from rotation of the eccentric load interact with the resilient characteristic of at least a subset of the plurality of legs to cause the plurality of legs to leave the supporting surface as the apparatus translates in the forward direction. The forces from rotation of the eccentric load interact with the resilient characteristic of at least a subset of the plurality of legs to cause the at least one driving leg to leave the supporting surface by a greater distance than others in the plurality of legs as the apparatus translates in the forward direction. At least one leg is adapted to drag, and the at least one leg adapted to drag includes a leg that is in contact with the supporting surface a greater relative amount of time than the at least one driving leg as forces from rotation of the eccentric load interact with the resilient characteristic of at least a subset of the plurality of legs to cause the plurality of legs to leave the supporting surface. A coefficient of friction of a portion of at least a subset of the legs that contact a support surface is sufficient to substantially eliminate drifting in a lateral direction. The at least one driving leg is configured to tend to bend, in a direction opposite the direction of movement, without substantial slippage on a support surface when a net downward force exists between the one or more driving legs and the support surface, where bending of the at least driving leg induces the movement in the forward direction. The at least one leg is configured to tend to return to a neutral position without inducing a sufficient force opposite the direction of movement to overcome a momentum of the apparatus resulting from the movement in the forward direction and/or to overcome a frictional force between one or more other legs of the plurality of legs and the support surface when a net upward force exists between the at least one driving leg and the support surface.

In general, another aspect of the subject matter described in this specification can be embodied in apparatus that include a housing, a rotational motor situated within the housing, an eccentric load adapted to be rotated by the rotational motor, and a plurality of molded legs each having a leg base and a leg tip at a distal end relative to the leg base. The legs are coupled to the housing at the leg base and include at least one driving leg configured to cause the apparatus to move in a forward direction generally defined by an offset between the leg base and the leg tip as the rotational motor rotates the eccentric load. The at least one driving leg is configured to tend to bend, in a direction opposite the direction of movement, without substantial slippage on a support surface when a net downward force exists between the at least one driving leg and the support surface. The at least one driving leg is also configured to tend to return to a neutral position without inducing a sufficient force opposite the direction of movement to overcome a momentum in the forward direction.

In general, another aspect of the subject matter described in this specification can be embodied in apparatus that include a housing, a rotational motor situated within the housing, an eccentric load adapted to be rotated by the rotational motor, and a plurality of legs each having a leg base and a leg tip at a distal end relative to the leg base. The legs are coupled to the housing at the leg base and include at least one driving leg constructed from a flexible material and configured to cause the apparatus to move in a direction generally defined by an offset between the leg base and the leg tip as the rotational motor rotates the eccentric load. Fewer than twenty legs contact a support surface as the at least one driving leg causes the apparatus to move.

These and other embodiments can each optionally include one or more of the following features. Fewer than twenty legs provide support when the apparatus is in an upright position. The legs that provide support when the apparatus is in an upright position are sufficiently stiff that four or fewer legs capable of supporting the apparatus without substantial deformation when the apparatus is in an upright position. The legs that provide support deform less than five percent relative to the height of the device under the weight of the device. A coefficient of friction of a portion of legs that contact a support surface is sufficient to substantially eliminate drifting in a lateral direction as the at least one driving leg causes the apparatus to move. The legs that provide support are molded from a elastomeric material. At least a subset of the legs that provide support are molded from an elastomeric material. The legs that provide support are injection molded. The legs that are molded from an elastomeric material are substantially simultaneously integrally injection molded. The legs that are substantially simultaneously integrally injection molded from the elastomeric material are co-molded with at least a portion of the housing. At least a portion of the legs that provide support are curved. The legs that provide support are tapered. The housing includes at least a nose and two lateral sides and each leg is coupled to the housing in a vicinity of one of the lateral sides. A diameter of the at least one driving leg is at least five percent of the length of the leg. A diameter of the at least one driving leg is at least ten percent of the length of the leg.

In general, another aspect of the subject matter described in this specification can be embodied in apparatus that include a housing, a rotational motor situated within the housing, an eccentric load adapted to be rotated by the rotational motor, and a plurality of legs each having a leg base and a leg tip at a distal end relative to the leg base. The legs are coupled to the housing at the leg base and include at least one driving leg constructed from a flexible material and configured to cause the apparatus to move in a direction generally defined by an offset between the leg base and the leg tip as the rotational motor rotates the eccentric load. A coefficient of friction of a portion of at least a subset of the plurality of legs that contact a support surface is sufficient to substantially eliminate drifting in a lateral direction.

These and other embodiments can each optionally include one or more of the following features. The plurality of legs are constructed from an elastomeric material. The plurality of legs are molded from the elastomeric material. At least a subset of the legs and at least a portion of the housing are co-molded from an elastomeric material.

In general, another aspect of the subject matter described in this specification can be embodied in apparatus that include a housing, a rotational motor situated within the housing, an eccentric load adapted to be rotated by the rotational motor, and a plurality of molded legs each having a leg base and a leg tip at a distal end relative to the leg base. The molded legs are coupled to the housing at the leg base and include at least one driving leg constructed from a flexible material and configured to cause the apparatus to move in a direction generally defined by an offset between the leg base and the leg tip as the rotational motor rotates the eccentric load.

These and other embodiments can each optionally include one or more of the following features. A coefficient of friction of at least the driving leg is sufficient to substantially eliminate slipping on a support surface when rotation of the eccentric load causes a net downward force on the at least one driving leg. The plurality of molded legs are co-molded with at least a portion of the housing. The molded legs are injection molded. The plurality of molded legs are integrally molded. The plurality of molded legs are integrally molded with at least a portion of the housing. The integrally molded plurality of molded legs and portion of the housing are molded from an elastomeric material. The portion of the housing includes a nose section of the housing. The plurality of molded legs are curved. The plurality of molded legs are tapered.

In general, another aspect of the subject matter described in this specification can be embodied in apparatus that include a housing, a rotational motor situated within the housing, an eccentric load adapted to be rotated by the rotational motor, and a plurality of tapered legs each having a leg base and a leg tip at a distal end relative to the leg base. The tapered legs are coupled to the housing at the leg base and include at least one driving leg constructed from a flexible material and configured to cause the apparatus to move in a direction generally defined by an offset between the leg base and the leg tip as the rotational motor rotates the eccentric load.

These and other embodiments can each optionally include one or more of the following features. The plurality of tapered legs are injection molded. At least a portion of the plurality of tapered legs are curved in a direction from the leg base to the leg tip. A diameter of the at least one driving leg is at least five percent of the length of the driving leg. A diameter of each of the plurality of tapered legs is at least five percent of the length of the leg.

In general, another aspect of the subject matter described in this specification can be embodied in apparatus that include a housing, a rotational motor situated within the housing, an eccentric load adapted to be rotated by the rotational motor, and a plurality of curved legs each having a leg base and a leg tip at a distal end relative to the leg base. The curved legs are coupled to the housing at the leg base and include at least one driving leg constructed from a flexible material and configured to cause the apparatus to move in a direction generally defined by an offset between the leg base and the leg tip as the rotational motor rotates the eccentric load. The plurality of curved legs are curved in the direction generally defined by the offset between the leg base and the leg tip.

These and other embodiments can each optionally include one or more of the following features. The housing includes at least a nose and two lateral sides and each leg is coupled to the housing in a vicinity of one of the lateral sides. A diameter of each of the plurality of legs is at least five percent of the length of the leg.

In general, another aspect of the subject matter described in this specification can be embodied in apparatus that include a housing, a rotational motor situated within the housing, an eccentric load adapted to be rotated by the rotational motor, and a plurality of legs each having a leg base and a leg tip at a distal end relative to the leg base and each having a diameter of at least five percent of a length of the leg between the leg base and the leg tip. The legs are coupled to the housing at the leg base and include at least one driving leg constructed from a flexible material and configured to cause the apparatus to move in a direction generally defined by an offset between the leg base and the leg tip as the rotational motor rotates the eccentric load.

These and other embodiments can each optionally include one or more of the following features. Each of the plurality of legs includes a diameter of at least ten percent of the length of the leg.

In general, another aspect of the subject matter described in this specification can be embodied in apparatus that include a housing, a rotational motor situated within the housing, an eccentric load adapted to be rotated by the rotational motor, and a plurality of legs each having a leg base and a leg tip at a distal end relative to the leg base. The legs are coupled to the housing at the leg base and include at least one driving leg constructed from an elastomeric material and configured to cause the apparatus to move in a direction generally defined by an offset between the leg base and the leg tip as the rotational motor rotates the eccentric load.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
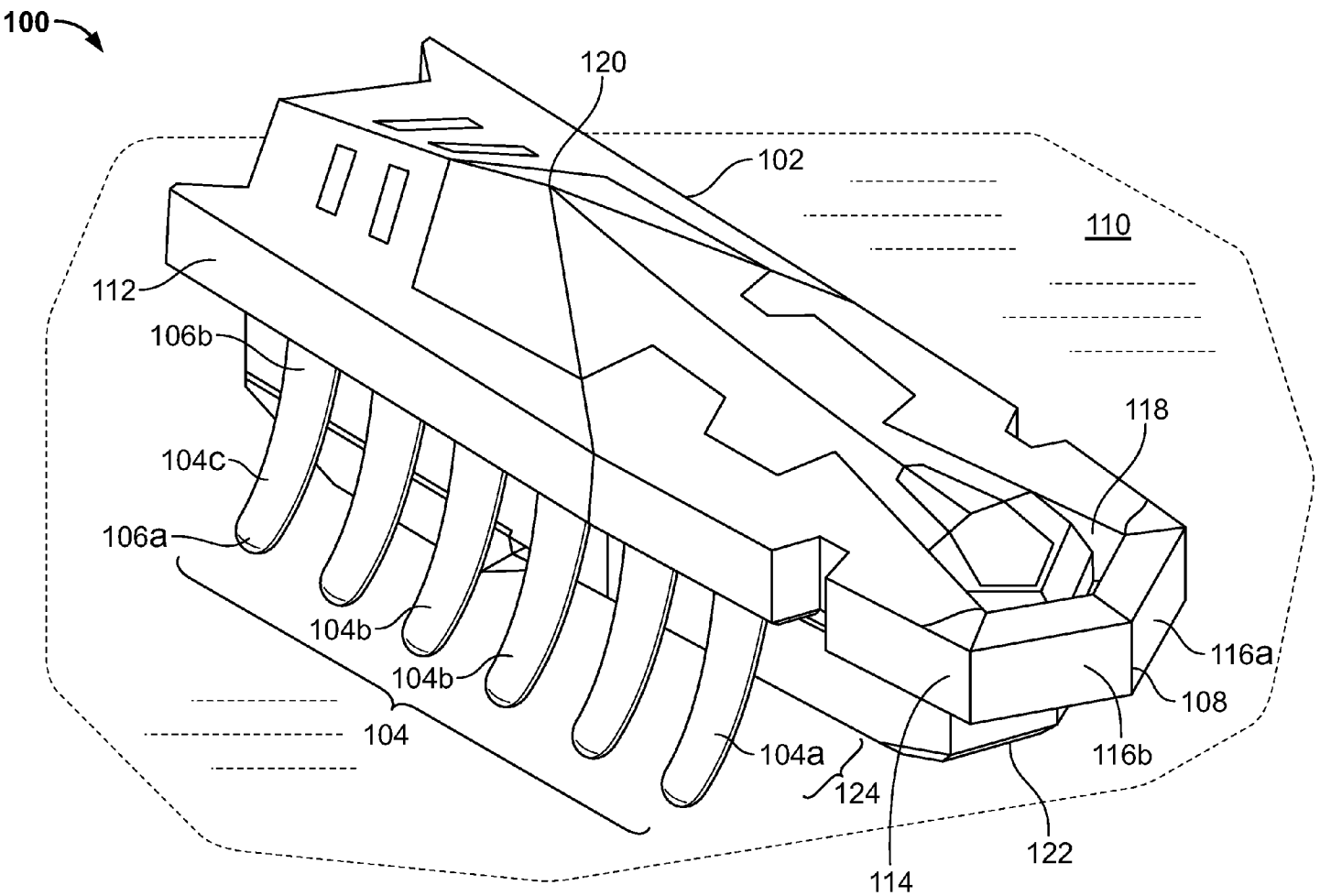
FIG. 1 is a diagram that illustrates an example vibration powered device.

Small robotic devices, or vibration-powered vehicles, can be designed to move across a surface, e.g., a floor, table, or other relatively flat surface. The robotic device is adapted to move autonomously and, in some implementations, turn in seemingly random directions. In general, the robotic devices include a housing, multiple legs, and a vibrating mechanism (e.g., a motor or spring-loaded mechanical winding mechanism rotating an eccentric load, a motor or other mechanism adapted to induce oscillation of a counterweight, or other arrangement of components adapted to rapidly alter the center of mass of the device). As a result, the miniature robotic devices, when in motion, can resemble organic life, such as bugs or insects.

Movement of the robotic device can be induced by the motion of a rotational motor inside of, or attached to, the device, in combination with a rotating weight with a center of mass that is offset relative to the rotational axis of the motor. The rotational movement of the weight causes the motor and the robotic device to which it is attached to vibrate. In some implementations, the rotation is approximately in the range of 6000-9000 revolutions per minute (rpm's), although higher or lower rpm values can be used. As an example, the device can use the type of vibration mechanism that exists in many pagers and cell phones that, when in vibrate mode, cause the pager or cell phone to vibrate. The vibration induced by the vibration mechanism can cause the device to move across the surface (e.g., the floor) using legs that are configured to alternately flex (in a particular direction) and return to the original position as the vibration causes the device to move up and down.

Various features can be incorporated into the robotic devices. For example, various implementations of the devices can include features (e.g., shape of the legs, number of legs, frictional characteristics of the leg tips, relative stiffness or flexibility of the legs, resiliency of the legs, relative location of the rotating counterweight with respect to the legs, etc.) for facilitating efficient transfer of vibrations to forward motion. The speed and direction of the robotic device's movement can depend on many factors, including the rotational speed of the motor, the size of the offset weight attached to the motor, the power supply, the characteristics (e.g., size, orientation, shape, material, resiliency, frictional characteristics, etc.) of the "legs" attached to the housing of the device, the properties of the surface on which the device operates, the overall weight of the device, and so on.

In some implementations, the devices include features that are designed to compensate for a tendency of the device to turn as a result of the rotation of the counterweight and/or to alter the tendency for, and direction of, turning between different robotic devices. The components of the device can be positioned to maintain a relatively low center of gravity (or center of mass) to discourage tipping (e.g., based on the lateral distance between the leg tips) and to align the components with the rotational axis of the rotating motor to encourage rolling (e.g., when the device is not upright). Likewise, the device can be designed to encourage self-righting based on features that tend to encourage rolling when the device is on its back or side in combination with the relative flatness of the device when it is upright (e.g., when the device is "standing" on its leg tips). Features of the device can also be used to increase the appearance of random motion and to make the device appear to respond intelligently to obstacles. Different leg configurations and placements can also induce different types of motion and/or different responses to vibration, obstacles, or other forces. Moreover, adjustable leg lengths can be used to provide some degree of steering capability. In some implementations, the robotic devices can simulate real-life objects, such as crawling bugs, rodents, or other animals and insects.

FIG. 1 is a diagram that illustrates an example device 100 that is shaped like a bug. The device 100 includes a housing 102 (e.g., resembling the body of the bug) and legs 104. Inside (or attached to) the housing 102 are the components that control and provide movement for the device 100, including a rotational motor, power supply (e.g., a battery), and an on/off switch. Each of the legs 104 includes a leg tip 106*a* and a leg base 106*b*. The properties of the legs 104, including the position of the leg base 106*b* relative to the leg tip 106*a*, can contribute to the direction and speed in which the device 100 tends to move. The device 100 is depicted in an upright position (i.e., standing on legs 104) on a supporting surface 110 (e.g., a substantially planar floor, table top, etc. that counteracts gravitational forces).

Overview of Legs

Legs 104 can include front legs 104*a*, middle legs 104*b*, and rear legs 104*c*. For example, the device 100 can include a pair of front legs 104*a* that may be designed to perform differently from middle legs 104*b* and rear legs 104*c*. For example, the front legs 104*a* may be configured to provide a driving force for the device 100 by contacting an underlying surface 110 and causing the device to hop forward as the device vibrates. Middle legs 104*b* can help provide support to counteract material fatigue (e.g., after the device 100 rests on the legs 104 for long periods of time) that may eventually cause the front legs 104*a* to deform and/or lose resiliency. In some implementations, device 100 can exclude middle legs 104*b* and include only front legs 104*a* and rear legs 104*c*. In some implementations, front legs 104*a* and one or more rear legs 104*c* can be designed to be in contact with a surface, while middle legs 104*b* can be slightly off the surface so that the middle legs 104*b* do not introduce significant additional drag forces and/or hopping forces that may make it more difficult to achieve desired movements (e.g., tendency to move in a relatively straight line and/or a desired amount of randomness of motion).

In some implementations, the device 100 can be configured such that only two front legs 104*a* and one rear leg 104*c* are in contact with a substantially flat surface 110, even if the device includes more than one rear leg 104*c* and several middle legs 104*b*. In other implementations, the device 100 can be configured such that only one front leg 104*a* and two rear legs 104*c* are in contact with a flat surface 110. Throughout this specification, descriptions of being in contact with the surface can include a relative degree of contact. For example, when one or more of the front legs 104*a* and one or more of the back legs 104*c* are described as being in contact with a substantially flat surface 110 and the middle legs 104*b* are described as not being in contact with the surface 110, it is also possible that the front and back legs 104*a* and 104*c* can simply be sufficiently longer than the middle legs 104*b* (and sufficiently stiff) that the front and back legs 104*a* and 104*c* provide more support for the weight of the device 100 than do the middle legs 104*b*, even though the middle legs 104*b* are technically actually in contact with the surface 110. In some implementations, even legs that have a lesser contribution to support of the device may nonetheless be in contact when the device 100 is in an upright position, especially when vibration of the device causes an up and down movement that compresses and bends the driving legs and allows additional legs to contact the surface 110. Greater predictability and control of movement (e.g., in a straight direction) can be obtained by constructing the device so that a sufficiently small number of legs (e.g., fewer than twenty or fewer than thirty) contact the support surface 110 and/or contribute to the support of the device in the upright position when the device is either at rest or as the rotating eccentric load induces movement. In this respect, it is possible for some legs to provide support even without contacting the support surface 110 (e.g., one or more short legs can provide stability by contacting an adjacent longer leg to increase overall stiffness of the adjacent longer leg). Typically, however, each leg is sufficiently stiff that four or fewer legs are capable of supporting the weight of the device without substantial deformation (e.g., less than 5% as a percentage of the height of the leg base 106*b* from the support surface 110 when the device 100 is in an upright position).

Different leg lengths can be used to introduce different movement characteristics, as further discussed below. The various legs can also include different properties, e.g., different stiffnesses or coefficients of friction, as further described below. Generally, the legs can be arranged in substantially parallel rows along each lateral side of the device 100 (e.g., FIG. 1 depicts one row of legs on the right lateral side of the device 100; a corresponding row of legs (not shown in FIG. 1) can be situated along the left lateral side of the device 100).

In general, the number of legs 104 that provide meaningful or any support for the device can be relatively limited. For example, the use of less than twenty legs that contact the support surface 110 and/or that provide support for the device 100 when the device 100 is in an upright position (i.e., an orientation in which the one or more driving legs 104*a* are in contact with a support surface) can provide more predictability in the directional movement tendencies of the device 100 (e.g., a tendency to move in a relatively straight and forward direction), or can enhance a tendency to move relatively fast by increasing the potential deflection of a smaller number of legs, or can minimize the number of legs that may need to be altered to achieve the desired directional control, or can improve the manufacturability of fewer legs with sufficient spacing to allow room for tooling. In addition to providing support by contacting the support surface 110, legs 104 can provide support by, for example, providing increased stability for legs that contact the surface 110. In some implementations, each of the legs that provides independent support for the device 100 is capable of supporting a substantial portion of the weight of the device 100. For example, the legs 104 can be sufficiently stiff that four or fewer legs are capable of statically (e.g., when the device is at rest) supporting the device without substantial deformation of the legs 104 (e.g., without causing the legs to deform such that the body of the device 100 moves more than 5% as a percentage of the height of the leg base 106*b* from the support surface).

As described here at a high level, many factors or features can contribute to the movement and control of the device 100. For example, the device's center of gravity (CG), and whether it is more forward or towards the rear of the device, can influence the tendency of the device 100 to turn. Moreover, a lower CG can help to prevent the device 100 from tipping over. The location and distribution of the legs 104 relative to the CG can also prevent tipping. For example, if pairs or rows of legs 104 on each side of the device 100 are too close together and the device 100 has a relatively high CG (e.g., relative to the lateral distance between the rows or pairs of legs), then the device 100 may have a tendency to tip over on its side. Thus, in some implementations, the device includes rows or pairs of legs 104 that provide a wider lateral stance (e.g., pairs of front legs 104*a*, middle legs 104*b*, and rear legs 104*c* are spaced apart by a distance that defines an approximate width of the lateral stance) than a distance between the CG and a flat supporting surface on which the device 100 rests in an upright position. For example, the distance between the CG and the supporting surface can be in the range of 50-80% of the value of the lateral stance (e.g., if the lateral stance is 0.5 inches, the CG may be in the range of 0.25-0.4 inches from the surface 110). Moreover, the vertical location of the CG of the device 100 can be within a range of 40-60% of the distance between a plane that passes through the leg tips 106*a* and the highest protruding surface on the top side of the housing 102.

Figure 4:
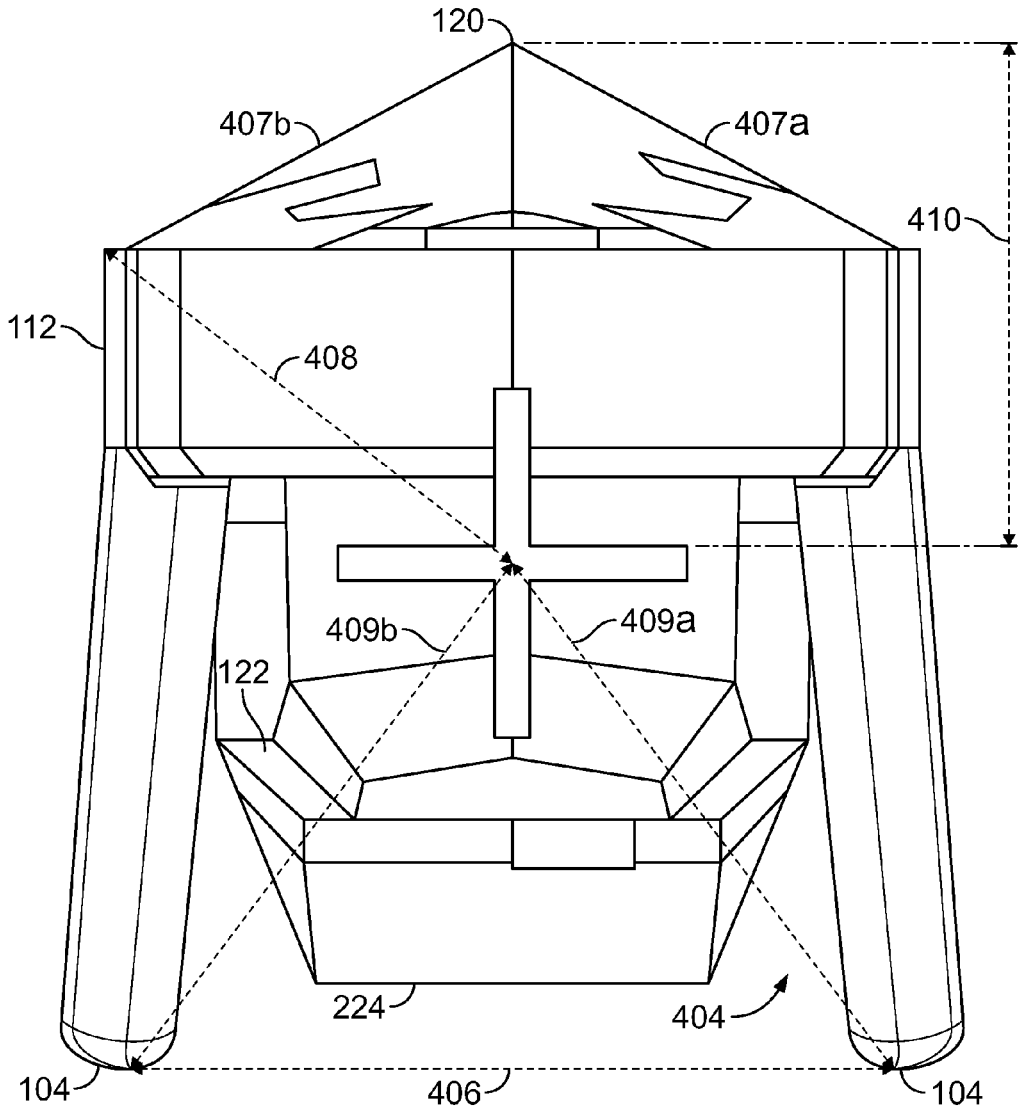
FIG. 4 shows an example front view indicating a center of gravity for the device.

In some implementations, a distance 409*a* and 409*b* (as shown in FIG. 4) between each row of the tips of legs 104 and a longitudinal axis of the device 100 that runs through the CG can be roughly the same or less than the distance 406 (as shown in FIG. 4) between the tips 106*a* of two rows of legs 104 to help facilitate stability when the device is resting on both rows of legs.

The device 100 can also include features that generally compensate for the device's tendency to turn. Driving legs (e.g., front legs 104*a*) can be configured such that one or more legs on one lateral side of the device 100 can provide a greater driving force than one or more corresponding legs on the other lateral side of the device 100 (e.g., through relative leg lengths, relative stiffness or resiliency, relative fore/aft location in the longitudinal direction, or relative lateral distance from the CG). Similarly, dragging legs (e.g., back legs 104*c*) can be configured such that one or more legs on one lateral side of the device 100 can provide a greater drag force than one or more corresponding legs on the other lateral side of the device 100 (e.g., through relative leg lengths, relative stiffness or resiliency, relative fore/aft location in the longitudinal direction, or relative lateral distance from the CG). In some implementations, the leg lengths can be tuned either during manufacturing or subsequently to modify (e.g., increase or reduce) a tendency of the device to turn.

Movement of the device can also be influenced by the leg geometry of the legs 104. For example, a longitudinal offset between the leg tip (i.e., the end of the leg that touches the surface 110) and the leg base (i.e., the end of the leg that attaches to the device housing) of any driving legs induces movement in a forward direction as the device vibrates. Including some curvature, at least in the driving legs, further facilitates forward motion as the legs tend to bend, moving the device forward, when vibrations force the device downward and then spring back to a straighter configuration as the vibrations force the device upward (e.g., resulting in hopping completely or partially off the surface, such that the leg tips move forward above or slide forward across the surface 110).

The ability of the legs to induce forward motion results in part from the ability of the device to vibrate vertically on the resilient legs. As shown in FIG. 1, the device 100 includes an underside 122. The power supply and motor for the device 100 can be contained in a chamber that is formed between the underside 122 and the upper body of the device, for example. The length of the legs 104 creates a space 124 (at least in the vicinity of the driving legs) between the underside 122 and the surface 110 on which the device 100 operates. The size of the space 124 depends on how far the legs 104 extend below the device relative to the underside 122. The space 124 provides room for the device 100 (at least in the vicinity of the driving legs) to move downward as the periodic downward force resulting from the rotation of the eccentric load causes the legs to bend. This downward movement can facilitate forward motion induced by the bending of the legs 104.

The device can also include the ability to self-right itself, for example, if the device 100 tips over or is placed on its side or back. For example, constructing the device 100 such that the rotational axis of the motor and the eccentric load are approximately aligned with the longitudinal CG of the device 100 tends to enhance the tendency of the device 100 to roll (i.e., in a direction opposite the rotation of the motor and the eccentric load). Moreover, construction of the device housing to prevent the device from resting on its top or side (e.g., using one or more protrusions on the top and/or sides of the device housing) and to increase the tendency of the device to bounce when on its top or side can enhance the tendency to roll. Furthermore, constructing the legs of a sufficiently flexible material and providing clearance on the housing undercarriage that the leg tips to bend inward can help facilitate rolling of the device from its side to an upright position.

FIG. 1 shows a body shoulder 112 and a head side surface 114, which can be constructed from rubber, elastomer, or other resilient material, contributing to the device's ability to self-right after tipping. The bounce from the shoulder 112 and the head side surface 114 can be significantly more than the lateral bounce achieved from the legs, which can be made of rubber or some other elastomeric material, but which can be less resilient than the shoulder 112 and the head side surface 114 (e.g., due to the relative lateral stiffness of the shoulder 112 and the head side surface 114 compared to the legs 104). Rubber legs 104, which can bend inward toward the body 102 as the device 100 rolls, increase the self-righting tendency, especially when combined with the angular/rolling forces induced by rotation of the eccentric load. The bounce from the shoulder 112 and the head side surface 114 can also allow the device 100 to become sufficiently airborne that the angular forces induced by rotation of the eccentric load can cause the device to roll, thereby facilitating self-righting.

The device can also be configured to include a degree of randomness of motion, which can make the device 100 appear to behave like an insect or other animate object. For example, vibration induced by rotation of the eccentric load can further induce hopping as a result of the curvature and "tilt" of the legs. The hopping can further induce a vertical acceleration (e.g., away from the surface 110) and a forward acceleration (e.g., generally toward the direction of forward movement of the device 100). During each hop, the rotation of the eccentric load can further cause the device to turn toward one side or the other depending on the location and direction of movement of the eccentric load. The degree of random motion can be increased if relatively stiffer legs are used to increase the amplitude of hopping. The degree of random motion can be influenced by the degree to which the rotation of the eccentric load tends to be either in phase or out of phase with the hopping of the device (e.g., out of phase rotation relative to hopping may increase the randomness of motion). The degree of random motion can also be influenced by the degree to which the back legs 104*c* tend to drag. For example, dragging of back legs 104*c* on both lateral sides of the device 100 may tend to keep the device 100 traveling in a more straight line, while back legs 104*c* that tend to not drag (e.g., if the legs bounce completely off the ground) or dragging of back legs 104*c* more on one side of the device 100 than the other can tend to increase turning.

Another feature is "intelligence" of the device 100, which can allow the device to interact in an apparently intelligent manner with obstacles, including, for example, bouncing off any obstacles (e.g., walls, etc.) that the device 100 encounters during movement. For example, the shape of the nose 108 and the materials from which the nose 108 is constructed can enhance a tendency of the device to bounce off of obstacles and to turn away from the obstacle. Each of these features can contribute to how the device 100 moves, and will be described below in more detail.

FIG. 1 illustrates a nose 108 that can contribute to the ability of the device 100 to deflect off of obstacles. Nose left side 116*a* and nose right side 116*b* can form the nose 108. The nose sides 116*a* and 116*b* can form a shallow point or another shape that helps to cause the device 100 to deflect off obstacles (e.g., walls) encountered as the device 100 moves in a generally forward direction. The device 100 can includes a space within the head 118 that increases bounce by making the head more elastically deformable (i.e., reducing the stiffness). For example, when the device 100 crashes nose-first into an obstacle, the space within the head 118 allows the head of the device 100 to compress, which provides greater control over the bounce of the device 100 away from the obstacle than if the head 118 is constructed as a more solid block of material. The space within the head 118 can also better absorb impact if the device falls from some height (e.g., a table). The body shoulder 112 and head side surface 114, especially when constructed from rubber or other resilient material, can also contribute to the device's tendency to deflect or bounce off of obstacles encountered at a relatively high angle of incidence.

Wireless/Remote Control Embodiments

In some implementations, the device 100 includes a receiver that can, for example, receive commands from a remote control unit. Commands can be used, for example, to control the device's speed and direction, and whether the device is in motion or in a motionless state, to name a few examples. In some implementations, controls in the remote control unit can engage and disengage the circuit that connects the power unit (e.g., battery) to the device's motor, allowing the operator of the remote control to start and stop the device 100 at any time. Other controls (e.g., a joy stick, sliding bar, etc.) in the remote control unit can cause the motor in the device 100 to spin faster or slower, affecting the speed of the device 100. The controls can send the receiver on the device 100 different signals, depending on the commands that correspond to the movement of the controls. Controls can also turn on and off a second motor attached to a second eccentric load in the device 100 to alter lateral forces for the device 100, thereby changing a tendency of the device to turn and thus providing steering control. Controls in a remote control unit can also cause mechanisms in the device 100 to lengthen or shorten one or more of the legs and/or deflecting one or more of the legs forward, backward, or laterally to provide steering control.

Leg Motion and Hop

FIGS. 2A through 2D are diagrams that illustrate example forces that induce movement of the device 100 of FIG. 1. Some forces are provided by a rotational motor 202, which enable the device 100 to move autonomously across the surface 110. For example, the motor 202 can rotate an eccentric load 210 that generates moment and force vectors 205-215 as shown in FIGS. 2A-2D. Motion of the device 100 can also depend in part on the position of the legs 104 with respect to the counterweight 210 attached to the rotational motor 202. For example, placing the counterweight 210 in front of the front legs 104*a* will increase the tendency of the front legs 104*a* to provide the primary forward driving force (i.e., by focusing more of the up and down forces on the front legs). For example, the distance between the counterweight 210 and the tips of the driving legs can be within a range of 20-100% of an average length of the driving legs. Moving the counterweight 210 back relative to the front legs 104*a* can cause other legs to contribute more to the driving forces.

Figure 2B:
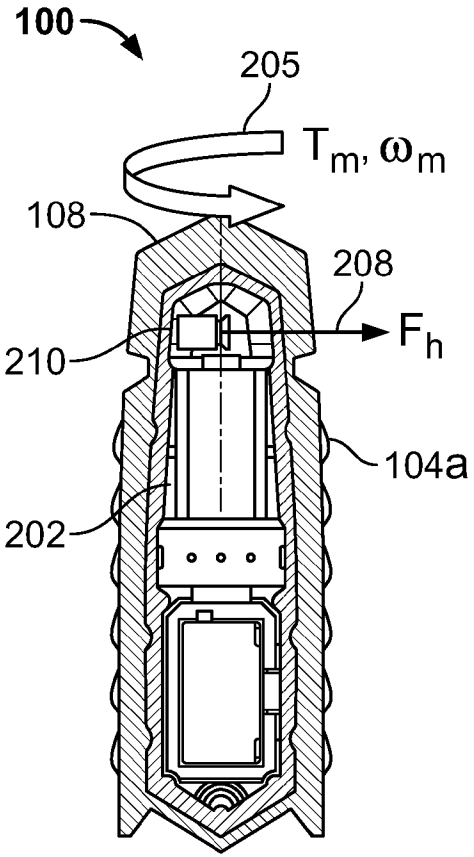
FIGS. 2A through 2D are diagrams that illustrate example forces that are involved with movement of the vibration powered device of FIG. 1.
Figure 2A:
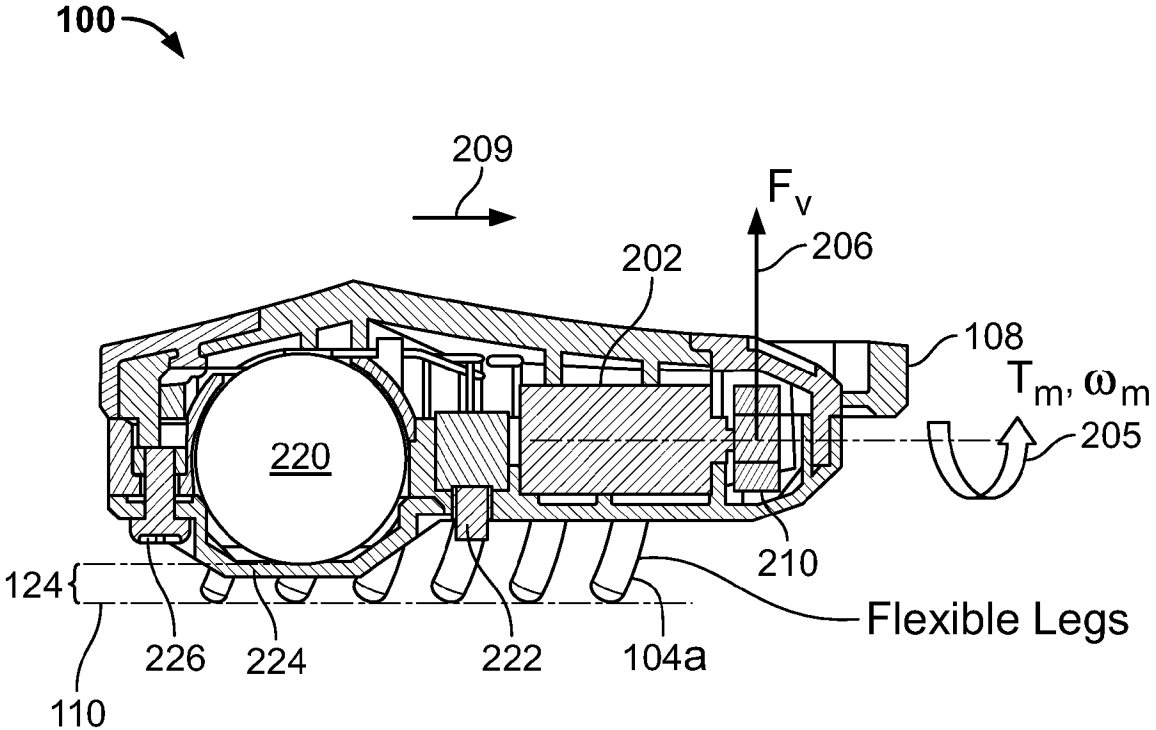

FIG. 2A shows a side view of the example device 100 shown in FIG. 1 and further depicts a rotational moment 205 (represented by the rotational velocity $\omega_m$ and motor torque $T_m$) and a vertical force 206 represented by $F_v$. FIG. 2B shows a top view of the example device 100 shown in FIG. 1 and further shows a horizontal force 208 represented by $F_h$. Generally, a negative $F_v$ is caused by upward movement of the eccentric load as it rotates, while a positive $F_v$ can be caused by the downward movement of the eccentric load and/or the resiliency of the legs (e.g., as they spring back from a deflected position).

The forces $F_v$ and $F_h$ cause the device 100 to move in a direction that is consistent with the configuration in which the leg base 106*b* is positioned in front of the leg tip 106*a*. The direction and speed in which the device 100 moves can depend, at least in part, on the direction and magnitude of $F_v$ and $F_h$. When the vertical force 206, $F_v$, is negative, the device 100 body is forced down. This negative $F_v$ causes at least the front legs 104*a* to bend and compress. The legs generally compress along a line in space from the leg tip to the leg base. As a result, the body will lean so that the leg bends (e.g., the leg base 106*b* flexes (or deflects) about the leg tip 106*a* towards the surface 110) and causes the body to move forward (e.g., in a direction from the leg tip 106*a* towards the leg base 106*b*). $F_v$, when positive, provides an upward force on the device 100 allowing the energy stored in the compressed legs to release (lifting the device), and at the same time allowing the legs to drag or hop forward to their original position. The lifting force $F_v$ on the device resulting from the rotation of the eccentric load combined with the spring-like leg forces are both involved in allowing the vehicle to hop vertically off the surface (or at least reducing the load on the front legs 104*a*) and allowing the legs 104 to return to their normal geometry (i.e., as a result of the resiliency of the legs). The release of the spring-like leg forces, along with the forward momentum created as the legs bend, propels the vehicle forward and upward, based on the angle of the line connecting the leg tip to the leg base, lifting the front legs 104*a* off the surface 110 (or at least reducing the load on the front legs 104*a*) and allowing the legs 104 to return to their normal geometry (i.e., as a result of the resiliency of the legs).

Generally, two "driving" legs (e.g., the front legs 104*a*, one on each side) are used, although some implementations may include only one driving leg or more than two driving legs. Which legs constitute driving legs can, in some implementations, be relative. For example, even when only one driving leg is used, other legs may provide a small amount of forward driving forces. During the forward motion, some legs 104 may tend to drag rather than hop. Hop refers to the result of the motion of the legs as they bend and compress and then return to their normal configuration—depending on the magnitude of $F_v$, the legs can either stay in contact with the surface or lift off the surface for a short period of time as the nose is elevated. For example, if the eccentric load is located toward the front of the device 100, then the front of the device 100 can hop slightly, while the rear of the device 100 tends to drag. In some cases, however, even with the eccentric load located toward the front of the device 100, even the back legs 104*c* may sometimes hop off the surface, albeit to a lesser extent than the front legs 104*a*. Depending on the stiffness or resiliency of the legs, the speed of rotation of the rotational motor, and the degree to which a particular hop is in phase or out of phase with the rotation of the motor, a hop can range in duration from less than the time required for a full rotation of the motor to the time required for multiple rotations of the motor. During a hop, rotation of the eccentric load can cause the device to move laterally in one direction or the other (or both at different times during the rotation) depending on the lateral direction of rotation at any particular time and to move up or down (or both at different times during the rotation) depending on the vertical direction of rotation at any particular time.

Increasing hop time can be a factor in increasing speed. The more time that the vehicle spends with some of the leg off the surface 110 (or lightly touching the surface), the less time some of the legs are dragging (i.e., creating a force opposite the direction of forward motion) as the vehicle translates forward. Minimizing the time that the legs drag forward (as opposed to hop forward) can reduce drag caused by friction of the legs sliding along the surface 110. In addition, adjusting the CG of the device fore and aft can effect whether the vehicle hops with the front legs only, or whether the vehicle hops with most, if not all, of the legs off the ground. This balancing of the hop can take into account the CG, the mass of the offset weight and its rotational frequency, $F_v$ and its location, and hop forces and their location(s).

Turning of Device

The motor rotation also causes a lateral force 208, $F_h$, which generally shifts back and forth as the eccentric load rotates. In general, as the eccentric load rotates (e.g., due to the motor 202), the left and right horizontal forces 208 are equal. The turning that results from the lateral force 208 on average typically tends to be greater in one direction (right or left) while the device's nose 108 is elevated, and greater in the opposite direction when the device's nose 108 and the legs 104 are compressed down. During the time that the center of the eccentric load 210 is traveling upward (away from the surface 110), increased downward forces are applied to the legs 104, causing the legs 104 to grip the surface 110, minimizing lateral turning of the device 100, although the legs may slightly bend laterally depending on the stiffness of the legs 104. During the time when the eccentric load 210 is traveling downward, the downward force on the legs 104 decreases, and downward force of the legs 104 on the surface 110 can be reduced, which can allow the device to turn laterally during the time the downward force is reduced. The direction of turning generally depends on the direction of the average lateral forces caused by the rotation of the eccentric load 210 during the time when the vertical forces are positive relative to when the vertical forces are negative. Thus, the horizontal force 208, $F_h$, can cause the device 100 to turn slightly more when the nose 108 is elevated. When the nose 108 is elevated, the leg tips are either off the surface 110 or less downward force is on the front legs 104*a* which precludes or reduces the ability of the leg tips (e.g., leg tip 106*a*) to "grip" the surface 110 and to provide lateral resistance to turning. Features can be implemented to manipulate several motion characteristics to either counteract or enhance this tendency to turn.

The location of the CG can also influence a tendency to turn. While some amount of turning by the device 100 can be a desired feature (e.g., to make the device's movement appear random), excessive turning can be undesirable. Several design considerations can be made to compensate for (or in some cases to take advantage of) the device's tendency to turn. For example, the weight distribution of the device 100, or more specifically, the device's CG, can affect the tendency of the device 100 to turn. In some implementations, having CG relatively near the center of the device 100 and roughly centered about the legs 104 can increase a tendency for the device 100 to travel in a relatively straight direction (e.g., not spinning around).

Tuning the drag forces for different legs 104 is another way to compensate for the device's tendency to turn. For example, the drag forces for a particular leg 104 can depend on the leg's length, thickness, stiffness and the type of material from which the leg is made. In some implementations, the stiffness of different legs 104 can be tuned differently, such as having different stiffness characteristics for the front legs 104*a*, rear legs 104*c* and middle legs 104*b*. For example, the stiffness characteristics of the legs can be altered or tuned based on the thickness of the leg or the material used for the leg. Increasing the drag (e.g., by increasing a leg length, thickness, stiffness, and/or frictional characteristic) on one side of the device (e.g., the right side) can help compensate for a tendency of the device to turn (e.g., to the left) based on the force $F_h$ induced by the rotational motor and eccentric load.

Altering the position of the rear legs 104*c* is another way to compensate for the device's tendency to turn. For example, placing the legs 104 further toward the rear of the device 100 can help the device 100 travel in a more straight direction. Generally, a longer device 100 that has a relatively longer distance between the front and rear legs 104*c* may tend to travel in more of a straight direction than a device 100 that is shorter in length (i.e., the front legs 104*a* and rear legs 104*c* are closer together), at least when the rotating eccentric load is located in a relatively forward position on the device 100. The relative position of the rearmost legs 104 (e.g., by placing the rearmost leg on one side of the device farther forward or backward on the device than the rearmost leg on the other side of the device) can also help compensate for (or alter) the tendency to turn.

Various techniques can also be used to control the direction of travel of the device 100, including altering the load on specific legs, adjusting the number of legs, leg lengths, leg positions, leg stiffness, and drag coefficients. As illustrated in FIG. 2B, the lateral horizontal force 208, $F_h$, causes the device 100 to have a tendency to turn as the lateral horizontal force 208 generally tends to be greater in one direction than the other during hops. The horizontal force 208, $F_h$ can be countered to make the device 100 move in an approximately straight direction. This result can be accomplished with adjustments to leg geometry and leg material selection, among other things.

Figure 2D:
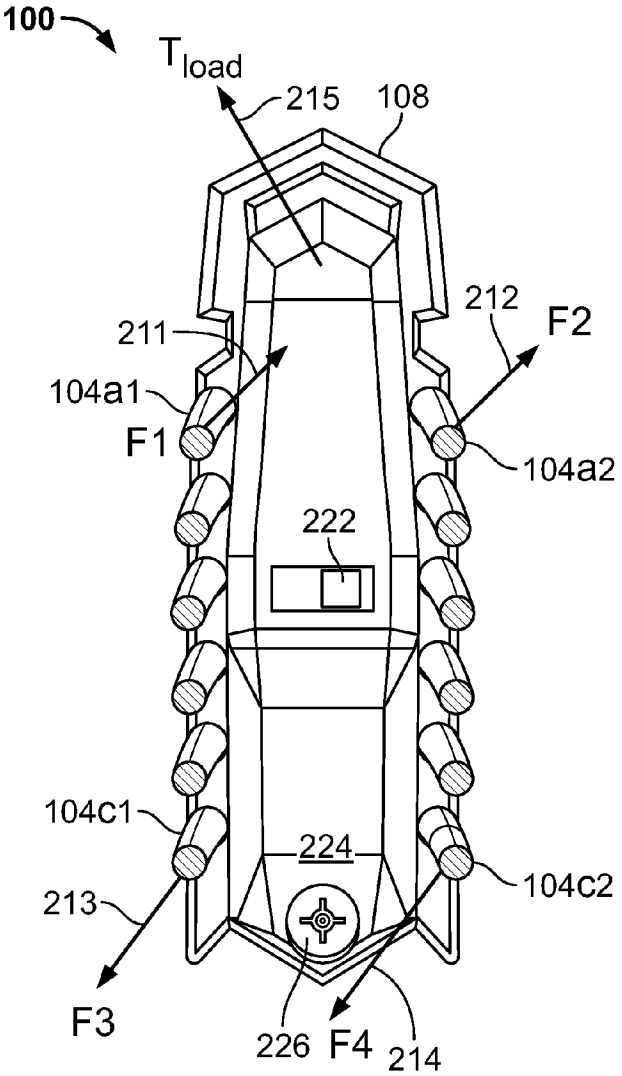
Figure 2C:
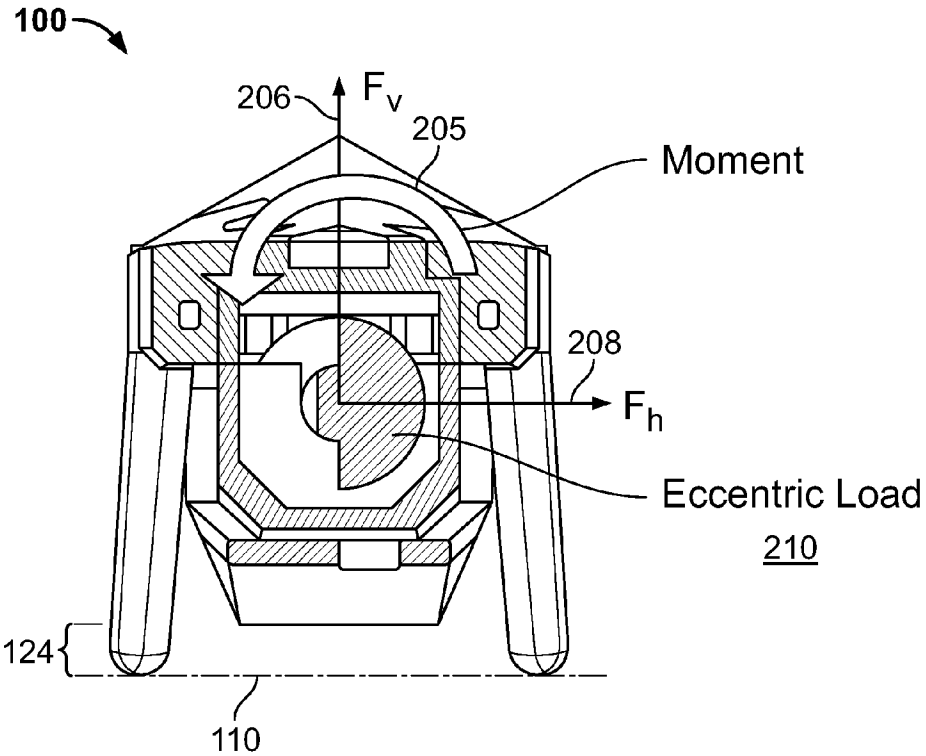

FIG. 2C is a diagram that shows a rear view of the device 100 and further illustrates the relationship of the vertical force 206 $F_v$ and the horizontal force 208 $F_h$ in relation to each other. This rear view also shows the eccentric load 210 that is rotated by the rotational motor 202 to generate vibration, as indicated by the rotational moment 205.

Drag Forces

FIG. 2D is a diagram that shows a bottom view of the device 100 and further illustrates example leg forces 211-214 that are involved with direction of travel of the device 100. In combination, the leg forces 211-214 can induce velocity vectors that impact the predominant direction of travel of the device 100. The velocity vector 215, represented by $T_{load}$, represents the velocity vector that is induced by the motor/eccentricity rotational velocity (e.g., induced by the offset load attached to the motor) as it forces the driving legs 104 to bend, causing the device to lunge forward, and as it generates greater lateral forces in one direction than the other during hopping. The leg forces 211-214, represented by $F_1$-$F_4$, represent the reactionary forces of the legs 104*a*1-104*c*2, respectively, that can be oriented so the legs 104*a*1-104*c*2, in combination, induce an opposite velocity vector relative to Thad. As depicted in FIG. 2D, $T_{load}$ is a velocity vector that tends to steer the device 100 to the left (as shown) due to the tendency for there to be greater lateral forces in one direction than the other when the device is hopping off the surface 110. At the same time, the forces $F_1$-$F_2$ for the front legs 104*a*1 and 104*a*2 (e.g., as a result of the legs tending to drive the device forward and slightly laterally in the direction of the eccentric load 210 when the driving legs are compressed) and the forces $F_3$-$F_4$ for the rear legs 104*c*1 and 104*c*2 (as a result of drag) each contribute to steering the device 100 to the right (as shown). (As a matter of clarification, because FIG. 2D shows the bottom view of the device 100, the left-right directions when the device 100 is placed upright are reversed.) In general, if the combined forces $F_1$-$F_4$ approximately offset the side component of $T_{load}$, then the device 100 will tend to travel in a relatively straight direction.

Controlling the forces $F_1$-$F_4$ can be accomplished in a number of ways. For example, the "push vector" created by the front legs 104*a*1 and 104*a*2 can be used to counter the lateral component of the motor-induced velocity. In some implementations, this can be accomplished by placing more weight on the front leg 104*a*2 to increase the leg force 212, represented by $F_2$, as shown in FIG. 2D. Furthermore, a "drag vector" can also be used to counter the motor-induced velocity. In some implementations, this can be accomplished by increasing the length of the rear leg 104*c*2 or increasing the drag coefficient on the rear leg 104*c*2 for the force vector 804, represented by $F_4$, in FIG. 2D. As shown, the legs 104*a*1 and 104*a*2 are the device's front right and left legs, respectively, and the legs 104*c*1 and 104*c*2 are the device's rear right and left legs, respectively.

Another technique for compensating for the device's tendency to turn is increasing the stiffness of the legs 104 in various combinations (e.g., by making one leg thicker than another or constructing one leg using a material having a naturally greater stiffness). For example, a stiffer leg will have a tendency to bounce more than a more flexible leg. Left and right legs 104 in any leg pair can have different stiffnesses to compensate for the turning of the device 100 induced by the vibration of the motor 202. Stiffer front legs 104*a* can also produce more bounce.

Another technique for compensating for the device's tendency to turn is to change the relative position of the rear legs 104*c*1 and 104*c*2 so that the drag vectors tend to compensate for turning induced by the motor velocity. For example, the rear leg 104*c*2 can be placed farther forward (e.g., closer to the nose 108) than the rear leg 104*c*1.

Leg Shape

Leg geometry contributes significantly to the way in which the device 100 moves. Aspects of leg geometry include: locating the leg base in front of the leg tip, curvature of the legs, deflection properties of the legs, configurations that result in different drag forces for different legs, including legs that do not necessarily touch the surface, and having only three legs that touch the surface, to name a few examples.

Generally, depending on the position of the leg tip 106*a* relative to the leg base 106*b*, the device 100 can experience different behaviors, including the speed and stability of the device 100. For example, if the leg tip 106*a* is nearly directly below the leg base 106*b* when the device 100 is positioned on a surface, movement of the device 100 that is caused by the motor 202 can be limited or precluded. This is because there is little or no slope to the line in space that connects the leg tip 106*a* and the leg base 106*b*. In other words, there is no "lean" in the leg 104 between the leg tip 106*a* and the leg base 106*b*. However, if the leg tip 106*a* is positioned behind the leg base 106*b* (e.g., farther from the nose 108), then the device 100 can move faster, as the slope or lean of the legs 104 is increased, providing the motor 202 with a leg geometry that is more conducive to movement. In some implementations, different legs 104 (e.g., including different pairs, or left legs versus right legs) can have different distances between leg tips 106*a* and leg bases 106*b*.

In some implementations, the legs 104 are curved (e.g., leg 104*a* shown in FIG. 2A, and legs 104 shown in FIG. 1). For example, because the legs 104 are typically made from a flexible material, the curvature of the legs 104 can contribute to the forward motion of the device 100. Curving the leg can accentuate the forward motion of the device 100 by increasing the amount that the leg compresses relative to a straight leg. This increased compression can also increase vehicle hopping, which can also increase the tendency for random motion, giving the device an appearance of intelligence and/or a more life-like operation. The legs can also have at least some degree of taper from the leg base 106*b* to the leg tip 106*a*, which can facilitate easier removal from a mold during the manufacturing process.

The number of legs can vary in different implementations. In general, increasing the number of legs 104 can have the effect of making the device more stable and can help reduce fatigue on the legs that are in contact with the surface 110. Increasing the number of legs can also affect the location of drag on the device 100 if additional leg tips 106*a* are in contact with the surface 110. In some implementations, however, some of the legs (e.g., middle legs 104*b*) can be at least slightly shorter than others so that they tend not to touch the surface 110 or contribute less to overall friction that results from the leg tips 106*a* touching the surface 110. For example, in some implementations, the two front legs 104*a* (e.g., the "driving" legs) and at least one of the rear legs 104*c* are at least slightly longer than the other legs. This configuration helps increase speed by increasing the forward driving force of the driving legs. In general, the remaining legs 104 can help prevent the device 100 from tipping over by providing additional resiliency should the device 100 start to lean toward one side or the other.

In some implementations, one or more of the "legs" can include any portion of the device that touches the ground. For example, the device 100 can include a single rear leg (or multiple rear legs) constructed from a relatively inflexible material (e.g., rigid plastic), which can resemble the front legs or can form a skid plate designed to simply drag as the front legs 104*a* provide a forward driving force. The oscillating eccentric load can repeat tens to several hundred times per second, which causes the device 100 to move in a generally forward motion as a result of the forward momentum generated when $F_v$ is negative.

Leg geometry can be defined and implemented based on ratios of various leg measurements, including leg length, diameter, and radius of curvature. One ratio that can be used is the ratio of the radius of curvature of the leg 104 to the leg's length. As just one example, if the leg's radius of curvature is 49.14 mm and the leg's length is 10.276 mm, then the ratio is 4.78. In another example, if the leg's radius of curvature is 2.0 inches and the leg's length is 0.4 inches, then the ratio is 5.0. Other leg 104 lengths and radii of curvature can be used, such as to produce a ratio of the radius of curvature to the leg's length that leads to suitable movement of the device 100. In general, the ratio of the radius of curvature to the leg's length can be in the range of 2.5 to 20.0. The radius of curvature can be approximately consistent from the leg base to the leg tip. This approximate consistent curvature can include some variation, however. For example, some taper angle in the legs may be required during manufacturing of the device (e.g., to allow removal from a mold). Such a taper angle may introduce slight variations in the overall curvature that generally do not prevent the radius of curvature from being approximately consistent from the leg base to the leg tip.

Another ratio that can be used to characterize the device 100 is a ratio that relates leg 104 length to leg diameter or thickness (e.g., as measured in the center of the leg or as measured based on an average leg diameter throughout the length of the leg and/or about the circumference of the leg). For example, the length of the legs 104 can be in the range of 0.2 inches to 0.8 inches (e.g., 0.405 inches) and can be proportional to (e.g., 5.25 times) the leg's thickness in the range of 0.03 to 0.15 inch (e.g., 0.077 inch). Stated another way, legs 104 can be about 15% to 25% as thick as they are long, although greater or lesser thicknesses (e.g., in the range of 5% to 60% of leg length) can be used. Leg 104 lengths and thicknesses can further depend on the overall size of the device 100. In general, at least one driving leg can have a ratio of the leg length to the leg diameter in the range of 2.0 to 20.0 (i.e., in the range of 5% to 50% of leg length). In some implementations, a diameter of at least 10% of the leg length may be desirable to provide sufficient stiffness to support the weight of the device and/or to provide desired movement characteristics.

Leg Material

The legs are generally constructed of rubber or other flexible but resilient material (e.g., polystyrene-butadiene-styrene with a durometer near 65, based on the Shore A scale, or in the range of 55-75, based on the Shore A scale). Thus, the legs tend to deflect when a force is applied. Generally, the legs include a sufficient stiffness and resiliency to facilitate consistent forward movement as the device vibrates (e.g., as the eccentric load 210 rotates). The legs 104 are also sufficiently stiff to maintain a relatively wide stance when the device 100 is upright yet allow sufficient lateral deflection when the device 100 is on its side to facilitate self-righting, as further discussed below.

The selection of leg materials can have an effect on how the device 100 moves. For example, the type of material used and its degree of resiliency can affect the amount of bounce in the legs 104 that is caused by the vibration of the motor 202 and the counterweight 210. As a result, depending on the material's stiffness (among other factors, including positions of leg tips 106*b* relative to leg bases 106*a*), the speed of the device 100 can change. In general, the use of stiffer materials in the legs 104 can result in more bounce, while more flexible materials can absorb some of the energy caused by the vibration of the motor 202, which can tend to decrease the speed of the device 100.

Frictional Characteristics

Friction (or drag) force equals the coefficient of friction multiplied by normal force. Different coefficients of friction and the resulting friction forces can be used for different legs. As an example, to control the speed and direction (e.g., tendency to turn, etc.), the leg tips 106*a* can have varying coefficients of friction (e.g., by using different materials) or drag forces (e.g., by varying the coefficients of friction and/or the average normal force for a particular leg). These differences can be accomplished, for example, by the shape (e.g., pointedness or flatness, etc.) of the leg tips 106*a* as well as the material of which they are made. Front legs 104*a*, for example, can have a higher friction than the rear legs 104*c*. Middle legs 104*b* can have yet different friction or can be configured such that they are shorter and do not touch the surface 110, and thus do not tend to contribute to overall drag. Generally, because the rear legs 104*c* (and the middle legs 104*b* to the extent they touch the ground) tend to drag more than they tend to create a forward driving force, lower coefficients of friction and lower drag forces for these legs can help increase the speed of the device 100. Moreover, to offset the motor force 215, which can tend to pull the device in a left or right direction, left and right legs 104 can have different friction forces. Overall, coefficients of friction and the resulting friction force of all of the legs 104 can influence the overall speed of the device 100. The number of legs 104 in the device 100 can also be used to determine coefficients of friction to have in (or design into) each of the individual legs 104. As discussed above, the middle legs 104*b* do not necessarily need to touch the surface 110. For example, middle (or front or back) legs 104 can be built into the device 100 for aesthetic reasons, e.g., to make the device 100 appear more life-like, and/or to increase device stability. In some implementations, devices 100 can be made in which only three (or a small number of) legs 104 touch the ground, such as two front legs 104*a* and one or two rear legs 104*c*.

The motor 202 is coupled to and rotates a counterweight 210, or eccentric load, that has a CG that is off axis relative to the rotational axis of the motor 202. The rotational motor 202 and counterweight 210, in addition to being adapted to propel the device 100, can also cause the device 100 to tend to roll, e.g., about the axis of rotation of the rotational motor 200. The rotational axis of the motor 202 can have an axis that is approximately aligned with a longitudinal CG of the device 100, which is also generally aligned with a direction of movement of the device 100.

FIG. 2A also shows a battery 220 and a switch 222. The battery 220 can provide power to the motor 202, for example, when the switch 222 is in the "ON" position, thus connecting an electrical circuit that delivers electric current to the motor 202. In the "OFF" position of the switch 222, the circuit is broken, and no power reaches the motor 202. The battery 220 can be located within or above a battery compartment cover 224, accessible, for example, by removing a screw 226, as shown in FIGS. 2A and 2D. The placement of the battery 220 and the switch 222 partially between the legs of the device 100 can lower the device's CG and help to prevent tipping. Locating the motor 202 lower within the device 100 also reduces tipping. Having legs 104 on the sides of a vehicle 100 provides a space (e.g., between the legs 104) to house the battery 220, the motor 204 and the switch 222. Positioning these components 204, 220 and 222 along the underside of the device 100 (e.g., rather than on top of the device housing) effectively lowers the CG of the device 100 and reduces its likelihood of tipping.

The device 100 can be configured such that the CG is selectively positioned to influence the behavior of the device 100. For example, a lower CG can help to prevent tipping of the device 100 during its operation. As an example, tipping can occur as a result of the device 100 moving at a high rate of speed and crashing into an obstacle. In another example, tipping can occur if the device 100 encounters a sufficiently irregular area of the surface on which it is operating. The CG of the device 100 can be selectively manipulated by positioning the motor, switch, and battery in locations that provide a desired CG, e.g., one that reduces the likelihood of inadvertent tipping. In some implementations, the legs can be configured so that they extend from the leg tip 106*a* below the CG to a leg base 106*b* that is above the CG, allowing the device 100 to be more stable during its operation. The components of the device 100 (e.g., motor, switch, battery, and housing) can be located at least partially between the legs to maintain a lower CG. In some implementations, the components of the device (e.g., motor, switch and battery) can be arranged or aligned close to the CG to maximize forces caused by the motor 202 and the counterweight 210.

Self-Righting

Self-righting, or the ability to return to an upright position (e.g., standing on legs 104), is another feature of the device 100. For example, the device 100 can occasionally tip over or fall (e.g., falling off a table or a step). As a result, the device 100 can end up on its top or its side. In some implementations, self-righting can be accomplished using the forces caused by the motor 202 and the counterweight 210 to cause the device 100 to roll over back onto its legs 104. Achieving this result can be helped by locating the device's CG proximal to the motor's rotational axis to increase the tendency for the entire device 100 to roll. This self-righting generally provides for rolling in the direction that is opposite to the rotation of the motor 202 and the counterweight 210.

Provided that a sufficient level of roll tendency is produced based on the rotational forces resulting from the rotation of the motor 202 and the counterweight 210, the outer shape of the device 100 can be designed such that rolling tends to occur only when the device 100 is on its right side, top side, or left side. For example, the lateral spacing between the legs 104 can be made wide enough to discourage rolling when the device 100 is already in the upright position. Thus, the shape and position of the legs 104 can be designed such that, when self-righting occurs and the device 100 again reaches its upright position after tipping or falling, the device 100 tends to remain upright. In particular, by maintaining a flat and relatively wide stance in the upright position, upright stability can be increased, and, by introducing features that reduce flatness when not in an upright position, the self-righting capability can be increased.

To assist rolling from the top of the device 100, a high point 120 or a protrusion can be included on the top of the device 100. The high point 120 can prevent the device from resting flat on its top. In addition, the high point 120 can prevent $F_h$ from becoming parallel to the force of gravity, and as a result, $F_h$ can provide enough moment to cause the device to roll, enabling the device100 to roll to an upright position or at least to the side of the device 100. In some implementations, the high point 120 can be relatively stiff (e.g., a relatively hard plastic), while the top surface of the head 118 can be constructed of a more resilient material that encourages bouncing. Bouncing of the head 118 of the device when the device is on its back can facilitate self-righting by allowing the device 100 to roll due to the forces caused by the motor 202 and the counterweight 210 as the head 118 bounces off the surface 110.

Rolling from the side of the device 100 to an upright position can be facilitated by using legs 104 that are sufficiently flexible in combination with the space 124 (e.g., underneath the device 100) for lateral leg deflection to allow the device 100 to roll to an upright position. This space can allow the legs 104 to bend during the roll, facilitating a smooth transition from side to bottom. The shoulders 112 on the device 100 can also decrease the tendency for the device 100 to roll from its side onto its back, at least when the forces caused by the motor 202 and the counterweight 210 are in a direction that opposes rolling from the side to the back. At the same time, the shoulder on the other side of the device 100 (even with the same configuration) can be designed to avoid preventing the device 100 from rolling onto its back when the forces caused by the motor 202 and the counterweight 210 are in a direction that encourages rolling in that direction. Furthermore, use of a resilient material for the shoulder can increase bounce, which can also increase the tendency for self-righting (e.g., by allowing the device 100 to bounce off the surface 110 and allowing the counterweight forces to roll the device while airborne). Self-righting from the side can further be facilitated by adding appendages along the side(s) of the device 100 that further separate the rotational axis from the surface and increase the forces caused by the motor 202 and the counterweight 210.

The position of the battery on the device 100 can affect the device's ability to roll and right itself For example, the battery can be oriented on its side, positioned in a plane that is both parallel to the device's direction of movement and perpendicular to the surface 110 when the device 100 is upright. This positioning of the battery in this manner can facilitate reducing the overall width of the device 100, including the lateral distance between the legs 104, making the device 100 more likely to be able to roll.

FIG. 4 shows an example front view indicating a center of gravity (CG) 402, as indicated by a large plus sign, for the device 100. This view illustrates a longitudinal CG 402 (i.e., a location of a longitudinal axis of the device 100 that runs through the device CG). In some implementations, the vehicle's components are aligned to place the longitudinal CG close to (e.g., within 5-10% as a percentage of the height of the vehicle) the physical longitudinal centerline of the vehicle, which can reduce the rotational moment of inertia of the vehicle, thereby increasing or maximizing the forces on the vehicle as the rotational motor rotates the eccentric load. As discussed above, this effect increases the tendency of the device 100 to roll, which can enhance the self-righting capability of the device. FIG. 4 also shows a space 404 between the legs 104 and the underside 122 of the vehicle 100 (including the battery compartment cover 224), which can allow the legs 104 to bend inward when the device is on its side, thereby facilitating self-righting of the device 100. FIG. 4 also illustrates a distance 406 between the pairs or rows of legs 104. Increasing the distance 406 can help prevent the vehicle 100 from tipping. However, keeping the distance 406 sufficiently low, combined with flexibility of the legs 104, can improve the vehicle's ability to self-right after tipping. In general, to prevent tipping, the distance 406 between pairs of legs needs to be increased proportionally as the CG 402 is raised.

The vehicle high point 120 is also shown in FIG. 4. The size or height of the high point 120 can be sufficiently large enough to prevent the device 100 from simply lying flat on its back after tipping, yet sufficiently small enough to help facilitate the device's roll and to force the device 100 off its back after tipping. A larger or higher high point 120 can be better tolerated if combined with "pectoral fins" or other side protrusions to increase the "roundness" of the device.

The tendency to roll of the device 100 can depend on the general shape of the device 100. For example, a device 100 that is generally cylindrical, particularly along the top of the device 100, can roll relatively easily. Even if the top of the device is not round, as is the case for the device shown in FIG. 4 that includes straight top sides 407*a* and 407*b*, the geometry of the top of the device 100 can still facilitate rolling. This is especially true if distances 408 and 410 are relatively equal and each approximately defines the radius of the generally cylindrical shape of the device 100. Distance 408, for example, is the distance from the device's longitudinal CG 402 to the top of the shoulder 112. Distance 410 is the distance from the device's longitudinal CG 402 to the high point 120. Further, having a length of surface 407*b* (i.e., between the top of the shoulder 112 and the high point 120) that is less than the distances 408 and 410 can also increase the tendency of the device 100 to roll. Moreover, if the device's longitudinal CG 402 is positioned relatively close to the center of the cylinder that approximates the general shape of the device 100, then roll of the device 100 is further enhanced, as the forces caused by the motor 202 and the counterweight 210 are generally more centered. The device 100 can stop rolling once the rolling action places the device 100 on its legs 104, which provide a wide stance and serve to interrupt the generally cylindrical shape of the device 100.

Figure 5:
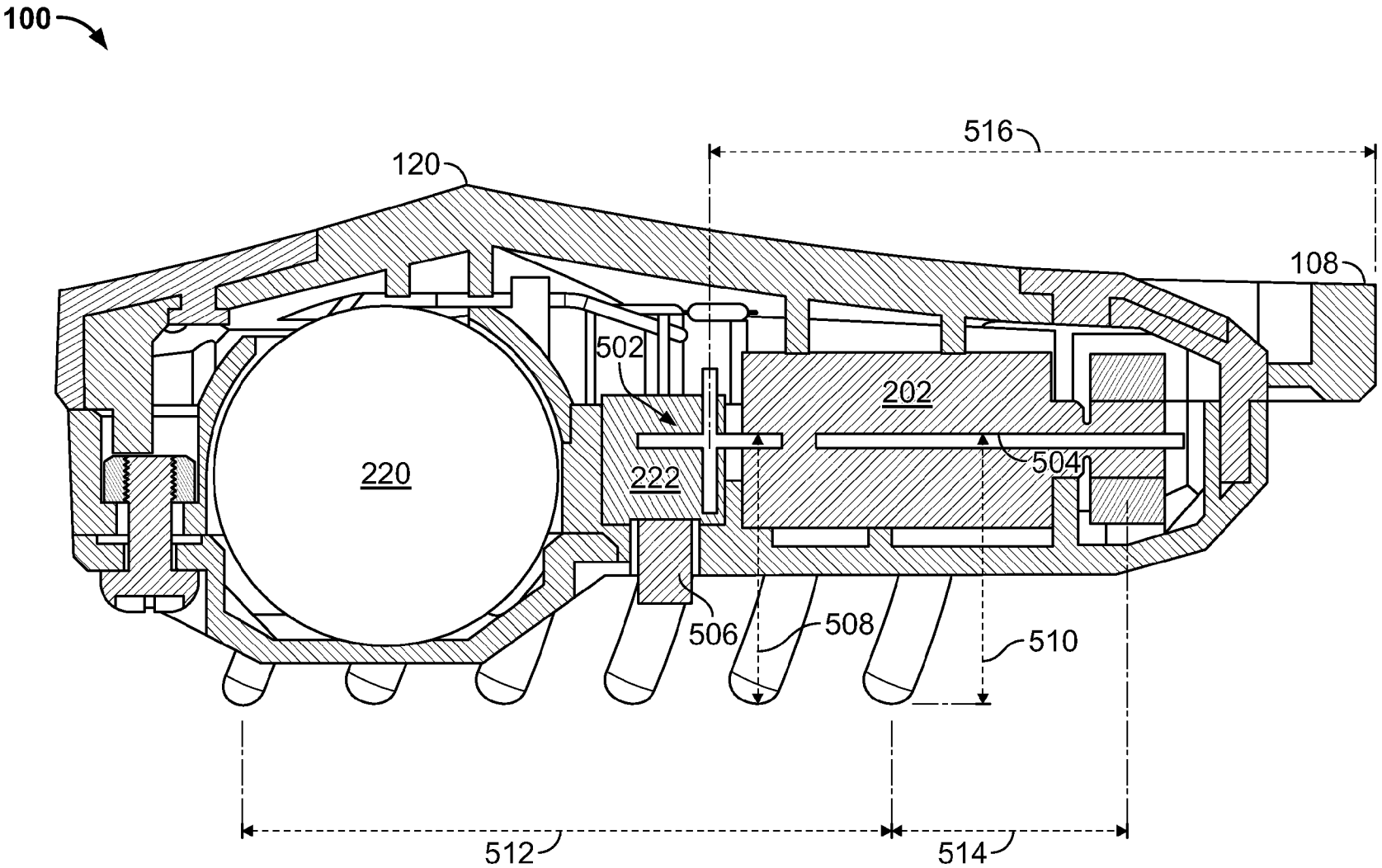
FIG. 5 shows an example side view indicating a center of gravity for the device.

FIG. 5 shows an example side view indicating a center of gravity (CG) 502, as indicated by a large plus sign, for the device 100. This view also shows a motor axis 504 which, in this example, closely aligns with the longitudinal component of the CG 502. The location of the CG 502 depends on, e.g., the mass, thickness, and distribution of the materials and components included in the device 100. In some implementations, the CG 502 can be farther forward or farther back from the location shown in FIG. 5. For example, the CG 502 can be located toward the rear end of the switch 222 rather than toward the front end of the switch 222 as illustrated in FIG. 5. In general, the CG 502 of the device 100 can be sufficiently far behind the front driving legs 104*a* and the rotating eccentric load (and sufficiently far in front of the rear legs 104*c*) to facilitate front hopping and rear drag, which can increase forward drive and provide a controlled tendency to go straight (or turn if desired) during hops. For example, the CG 502 can be positioned roughly halfway (e.g., in the range of roughly 40-60% of the distance) between the front driving legs 104*a* and the rear dragging legs 104*c*. Also, aligning the motor axis with the longitudinal CG can enhance forces caused by the motor 202 and the counterweight. In some implementations, the longitudinal component of the CG 502 can be near to the center of the height of the device (e.g., within about 3% of the CG as a proportion of the height of the device). Generally, configuring the device 100 such that the CG 502 is closer to the center of the height of the device will enhance the rolling tendency, although greater distances (e.g., within about 5% or within about 20% of the CG as a proportion of the height of the device) are acceptable in some implementations. Similarly, configuring the device 100 such that the CG 502 is within about 3-6% of the motor axis 504 as a percentage of the height of the device can also enhance the rolling tendency.

FIG. 5 also shows an approximate alignment of the battery 220, the switch 222 and the motor 202 with the longitudinal component of the CG 502. Although a sliding switch mechanism 506 that operates the on/off switch 222 hangs below the underside of the device 100, the overall approximate alignment of the CG of the individual components 220, 222 and 202 (with each other and with the CG 502 of the overall device 100) contributes to the ability of the device 100 to roll, and thus right itself. In particular, the motor 202 is centered primarily along the longitudinal component of the CG 502.

In some implementations, the high point 120 can be located behind the CG 502, which can facilitate self-righting in combination with the eccentric load attached to the motor 202 being positioned near the nose 108. As a result, if the device 100 is on its side or back, the nose end of the device 100 tends to vibrate and bounce (more so than the tail end of the device 100), which facilitates self-righting as the forces of the motor and eccentric load tend to cause the device to roll.

FIG. 5 also shows some of the sample dimensions of the device 100. For example, a distance 508 between the CG 502 and a plane that passes through the leg tips 106*a* on which the device 100 rests when upright on a flat surface 110 can be approximately 0.36 inches. In some implementations, this distance 508 is approximately 50% of the total height of the device (see FIGS. 7A & 7B), although other distances 508 may be used in various implementations (e.g., from about 40-60%). A distance 510 between the rotational axis 504 of the motor 202 and the same plane that passes through the leg tips 106*a* is approximately the same as the distance 508, although variations (e.g., 0.34 inches for distance 510 vs. 0.36 inches for distance 508) may be used without materially impacting desired functionality. Greater variations (e.g., 0.05 inches or even 0.1 inches) may be used in some implementations.

A distance 512 between the leg tip 106*a* of the front driving legs 104*a* and the leg tip 106*a* of the rearmost leg 104*c* can be approximately 0.85 inches, although various implementations can include other values of the distance 512 (e.g., between about 40% and about 75% of the length of the device 100). In some implementations, locating the front driving legs 104*a* behind the eccentric load 210 can facilitate forward driving motion and randomness of motion. For example, a distance 514 between a longitudinal centerline of the eccentric load 210 and the tip 106*a* of the front leg 104*a* can be approximately 0.36 inches. Again, other distances 514 can be used (e.g., between about 5% and about 30% of the length of the device 100 or between about 10% and about 60% of the distance 512). A distance 516 between the front of the device 100 and the CG 502 can be about 0.95 inches. In various implementations, the distance 516 may range from about 40-60% of the length of the device 100, although some implementations may include front or rear protrusions with a low mass that add to the length of the device but do not significantly impact the location of the CG 502 (i.e., therefore causing the CG 502 to be outside of the 40-60% range).

Figure 9A:
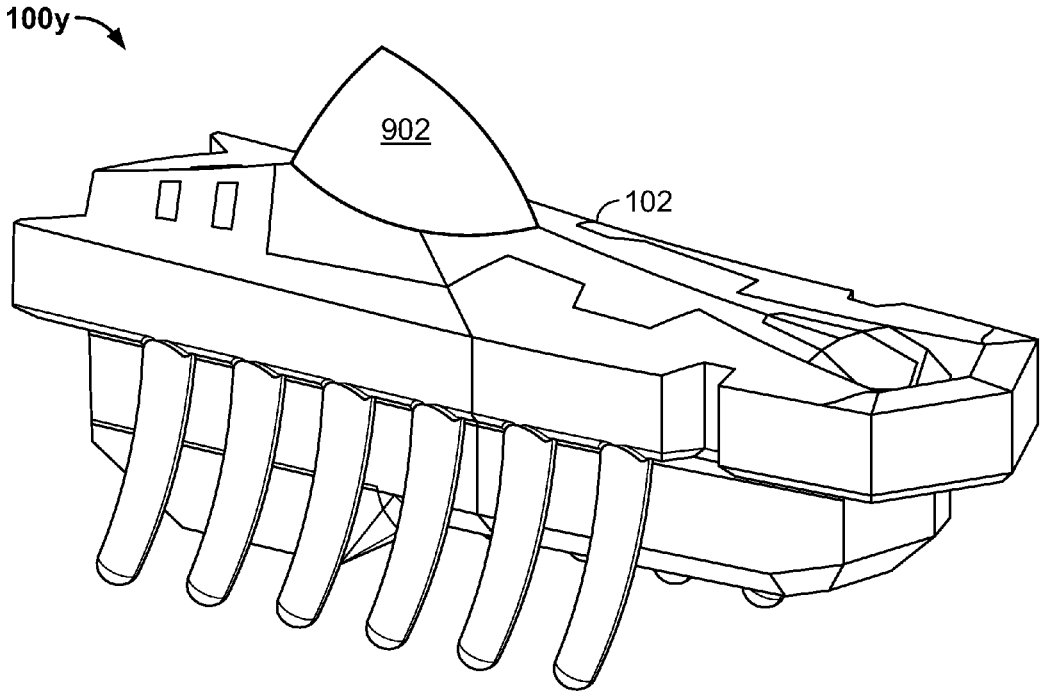
FIGS. 9A and 9B show example devices that include a shark/dorsal fin and a pair of side/pectoral fins, respectively.
Figure 9B:
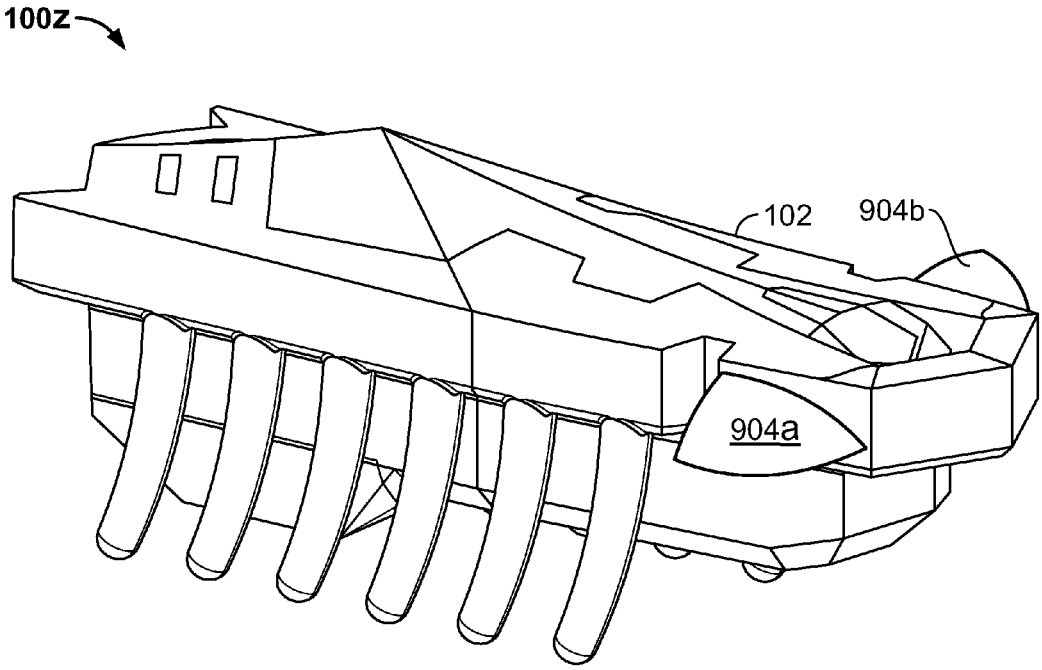

FIGS. 9A and 9B show example devices 100*y* and 100*z* that include, respectively, a shark/dorsal fin 902 and side/pectoral fins 904*a* and 904*b*. As shown in FIG. 9A, the shark/dorsal fin 902 can extend upward from the body 102 so that, if the device 100*y* tips, then the device 100*y* will not end up on its back and can right itself. The side/pectoral fins 904*a* and 904*b* shown in FIG. 9B extend partially outward from the body 102. As a result, if the device 100*z* begins to tip to the device's left or right, then the fin on that side (e.g., fin 904*a* or fin 904*b*) can stop and reverse the tipping action, returning the device 100*z* to its upright position. In addition, the fins 904*a* and 904*b* can facilitate self-righting by increasing the distance between the CG and the surface when the device is on its side. This effect can be enhanced when the fins 904*a* and 904*b* are combined with a dorsal fin 902 on a single device. In this way, fins 902, 904*a* and 904*b* can enhance the self-righting of the devices 100*y* and 100*z*. Constructing the fins 902, 904*a* and 904*b* from a resilient material that increases bounce when the fins are in contact with a surface can also facilitate self-righting (e.g., to help overcome the wider separation between the tips of the fins 902, 904*a* and 904*b*). Fins 902, 904*a* and 904*b* can be constructed of light-weight rubber or plastic so as not to significantly change the device's CG.

Random Motion

By introducing features that increase randomness of motion of the device 100, the device 100 can appear to behave in an animate way, such as like a crawling bug or other organic life-form. The random motion can include inconsistent movements, for example, rather than movements that tend to be in straight lines or continuous circles. As a result, the device 100 can appear to roam about its surroundings (e.g. in an erratic or serpentine pattern) instead of moving in predictable patterns. Random motion can occur, for example, even while the device 100 is moving in one general direction.

In some implementations, randomness can be achieved by changing the stiffness of the legs 104, the material used to make the legs 104, and/or by adjusting the inertial load on various legs 104. For example, as leg stiffness is reduced, the amount of device hopping can be reduced, thus reducing the appearance of random motion. When the legs 104 are relatively stiff, the legs 104 tend to induce hopping, and the device 100 can move in a more inconsistent and random motion.

While the material that is selected for the legs 104 can influence leg stiffness, it can also have other effects. For example, the leg material can be manipulated to attract dust and debris at or near the leg tips 106*a*, where the legs 104 contact the surface 110. This dust and debris can cause the device 100 to turn randomly and change its pattern of motion. This can occur because the dust and debris can alter the typical frictional characteristics of the legs 104.

The inertial load on each leg 104 can also influence randomness of motion of the device 100. As an example, as the inertial load on a particular leg 104 is increased, that portion of the device 100 can hop at higher amplitude, causing the device 100 to land in different locations.

In some implementations, during a hop and while at least some legs 104 of the device 100 are airborne (or at least applying less force to the surface 110), the motor 202 and the counterweight 210 can cause some level of mid-air turning and/or rotating of the device 100. This can provide the effect of the device landing or bouncing in unpredictable ways, which can further lead to random movement.

In some implementations, additional random movement can result from locating front driving legs 104*a* (i.e., the legs that primarily propel the device 100 forward) behind the motor's counterweight. This can cause the front of the device 100 to tend to move in a less straight direction because the counterweight is farther from legs 104 that would otherwise tend to absorb and control its energy. An example lateral distance from the center of the counterweight to the tip of the first leg of 0.36 inches compared to an example leg length of 0.40 inches. Generally, the distance 514 from the longitudinal centerline of the counterweight to the tip 106*a* of the front leg 104*a* may be approximately the same as the length of the leg but the distance 514 can vary in the range of 50-150% of the leg length.

In some implementations, additional appendages can be added to the legs 104 (and to the housing 102) to provide resonance. For example, flexible protrusions that are constantly in motion in this way can contribute to the overall randomness of motion of the device 100 and/or to the lifelike appearance of the device 100. Using appendages of different sizes and flexibilities can magnify the effect.

In some implementations, the battery 220 can be positioned near the rear of the device 100 to increase hop. Doing so positions the weight of the battery 220 over the rearmost legs 104, reducing load on the front legs 104*a*, which can allow for more hop at the front legs 104*a*. In general, the battery 220 can tend to be heavier than the switch 222 and motor 202, thus placement of the battery 220 nearer the rear of the device 100 can elevate the nose 108, allowing the device 100 to move faster.

In some implementations, the on/off switch 222 can be oriented along the bottom side of the device 100 between the battery 220 and the motor 204 such that the switch 222 can be moved back and forth laterally. Such a configuration, for example, helps to facilitate reducing the overall length of the device 100. Having a shorter device can enhance the tendency for random motion.

Speed of Movement

In addition to random motion, the speed of the device 100 can contribute to the life-like appearance of the device 100. Factors that affect speed include the vibration frequency and amplitude that are produced by the motor 202 and counterweight 210, the materials used to make the legs 104, leg length and deflection properties, differences in leg geometry, and the number of legs.

Vibration frequency (e.g., based on motor rotation speed) and device speed are generally directly proportional. That is, when the oscillating frequency of the motor 202 is increased and all other factors are held constant, the device 100 will tend to move faster. An example oscillating frequency of the motor is in the range of 7000 to 9000 rpm.

Leg material has several properties that contribute to speed. Leg material friction properties influence the magnitude of drag force on the device. As the coefficient of friction of the legs increases, the device's overall drag will increase, causing the device 100 to slow down. As such, the use of leg material having properties promoting low friction can increase the speed of the device 100. In some implementations, polystyrene-butadiene-styrene with a durometer near 65 (e.g., based on the Shore A scale) can be used for the legs 104. Leg material properties also contribute to leg stiffness which, when combined with leg thickness and leg length, determines how much hop a device 100 will develop. As the overall leg stiffness increases, the device speed will increase. Longer and thinner legs will reduce leg stiffness, thus slowing the device's speed.

Appearance of Intelligence

"Intelligent" response to obstacles is another feature of the device 100. For example, "intelligence" can prevent a device 100 that comes in contact with an immoveable object (e.g., a wall) from futilely pushing against the object. The "intelligence" can be implemented using mechanical design considerations alone, which can obviate the need to add electronic sensors, for example. For example, turns (e.g., left or right) can be induced using a nose 108 that introduces a deflection or bounce in which a device 100 that encounters an obstacle immediately turns to a near incident angle.

In some implementations, adding a "bounce" to the device 100 can be accomplished through design considerations of the nose and the legs 104, and the speed of the device 100. For example, the nose 108 can include a spring-like feature. In some implementations, the nose 108 can be manufactured using rubber, plastic, or other materials (e.g., polystyrene-butadiene-styrene with a durometer near 65, or in the range of 55-75, based on the Shore A scale). The nose 108 can have a pointed, flexible shape that deflects inward under pressure. Design and configuration of the legs 104 can allow for a low resistance to turning during a nose bounce. Bounce achieved by the nose can be increased, for example, when the device 100 has a higher speed and momentum.

In some implementations, the resiliency of the nose 108 can be such that it has an added benefit of dampening a fall should the device 100 fall off a surface 110 (e.g., a table) and land on its nose 108.

Figure 6:
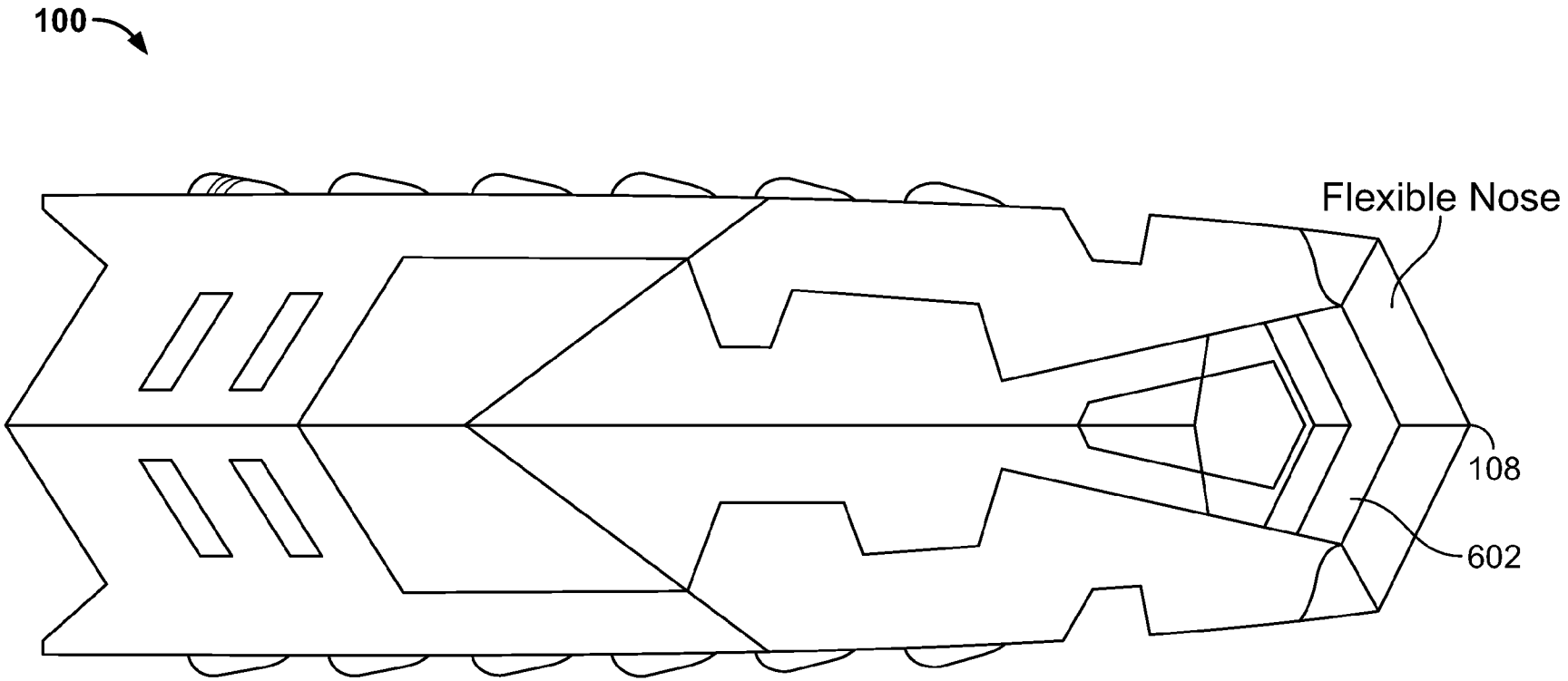
FIG. 6 shows a top view of the device and its flexible nose.

FIG. 6 shows a top view of the vehicle 100 and further shows the flexible nose 108. Depending on the shape and resiliency of the nose 108, the vehicle 100 can more easily deflect off obstacles and remain upright, instead of tipping. The nose 108 can be constructed from rubber or some other relatively resilient material that allows the device to bounce off obstacles. Further, a spring or other device can be placed behind the surface of the nose 108 that can provide an extra bounce. A void or hollow space 602 behind the nose 108 can also contribute to the device's ability to deflect off of obstacles that are encountered nose-first.

Alternative Leg Configurations

Figure 3A:
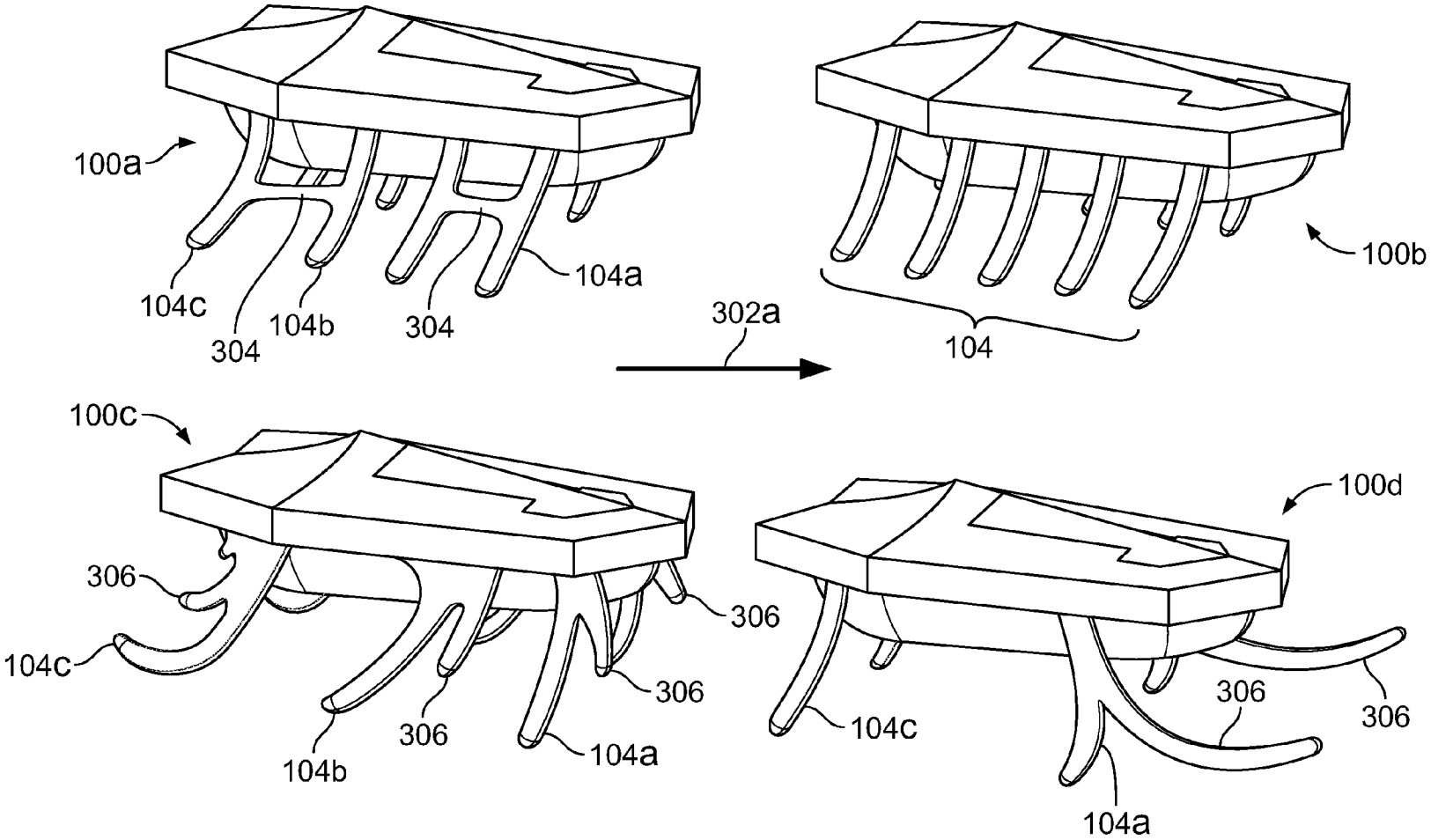
FIGS. 3A through 3C are diagrams that show various examples of alternative leg configurations for vibration powered devices.
Figure 3B:
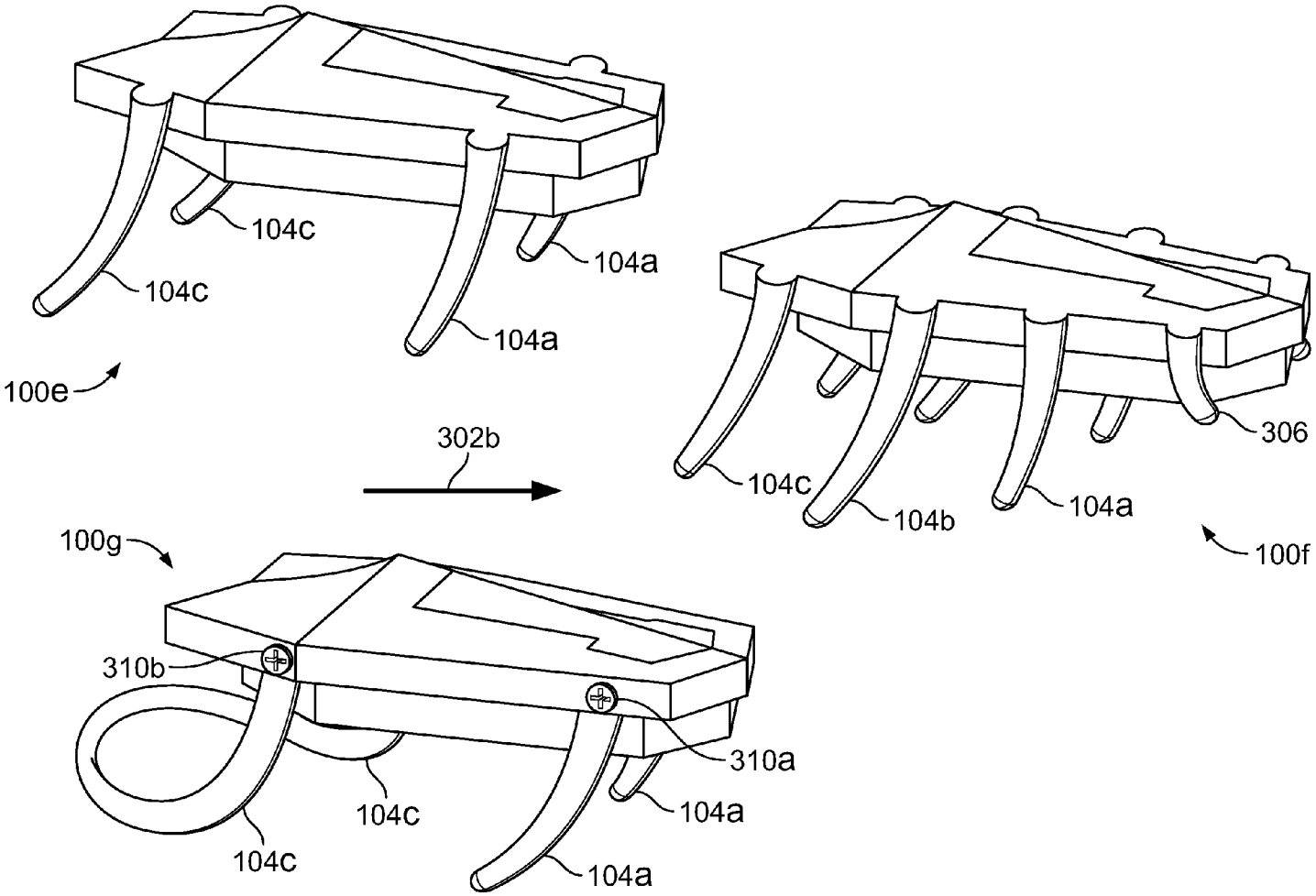
Figure 3C:
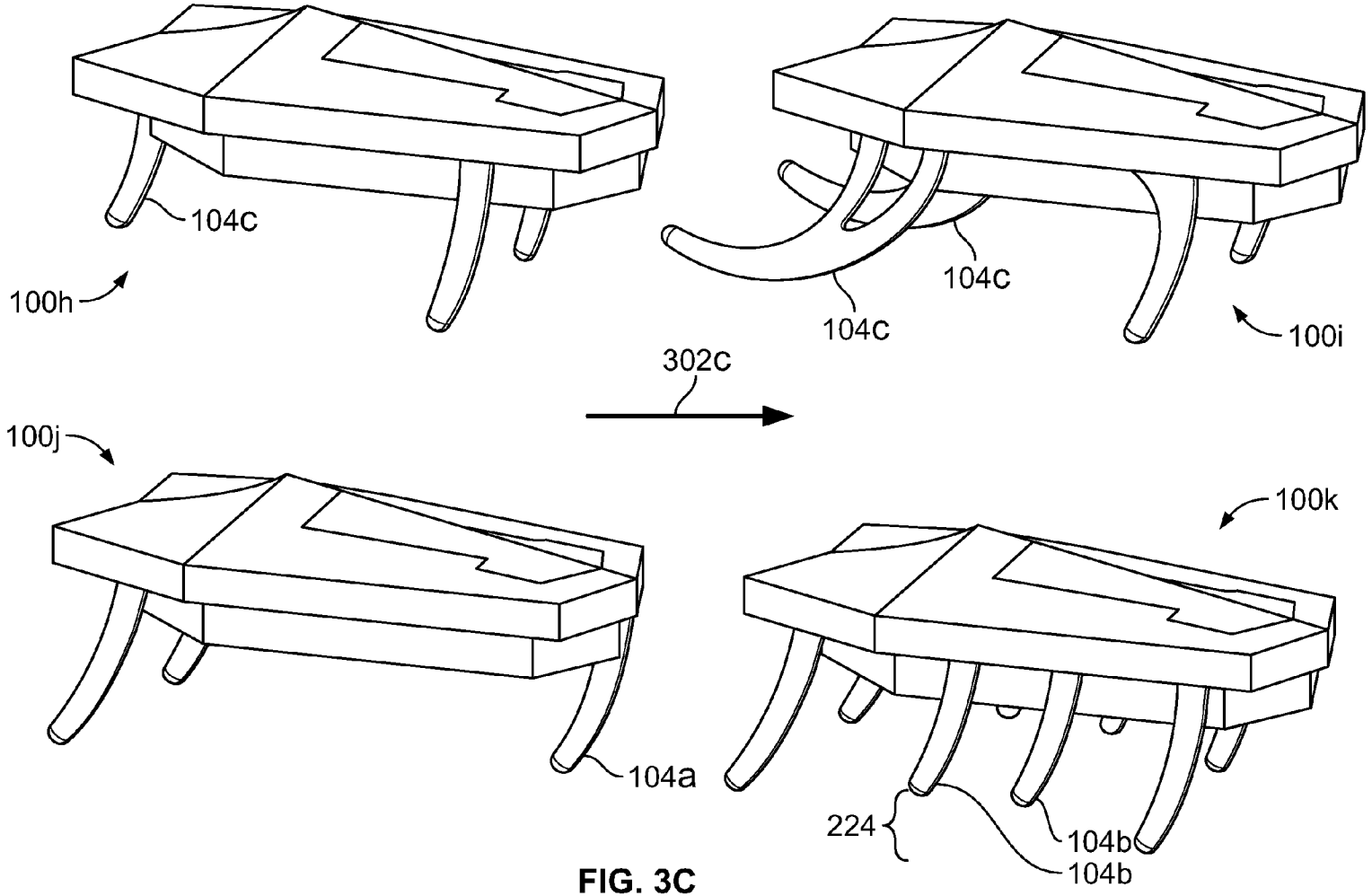

FIGS. 3A-3C show various examples of alternative leg configurations for devices 100*a*-100*k*. The devices 100*a*-100*k* primarily show leg 104 variations but can also include the components and features described above for the device 100. As depicted in FIGS. 3A-3C, the forward direction of movement is left-to-right for all of the devices 100*a*-100*k*, as indicated by direction arrows 302*a*-302*c*. The device 100*a* shows legs connected with webs 304. The webs 304 can serve to increase the stiffness of the legs 104 while maintaining legs 104 that appear long. The webs 304 can be anywhere along the legs 104 from the top (or base) to the bottom (or tip). Adjusting these webs 304 differently or on the device's right versus the left can serve to change leg characteristics without adjusting leg length and provide an alternate method of correcting steering. The device 100*b* shows a common configuration with multiple curved legs 104. In this implementation, the middle legs 104*b* may not touch the ground, which can make production tuning of the legs easier by eliminating unneeded legs from consideration. Devices 100*c* and 100*d* show additional appendages 306 that can add an additional life-like appearance to the devices 100*c* and 100*d*. The appendages 306 on the front legs can resonate as the devices 100*c* and 100*d* move. As described above, adjusting these appendages 306 to create a desired resonance can serve to increase randomness in motion.

Additional leg configurations are shown in FIG. 3B. The devices 100*e* and 100*f* show leg connections to the body that can be at various locations compared to the devices 100*a*-100*d* in FIG. 3A. Aside from aesthetic differences, connecting the legs 104 higher on the device's body can serve to make the legs 104 appear to be longer without raising the CG. Longer legs 104 generally have a reduced stiffness that can reduce hopping, among other characteristics. The device 100*f* also includes front appendages 306. The device 100*g* shows an alternate rear leg configuration where the two rear legs 104 are connected, forming a loop.

Additional leg configurations are shown in FIG. 3C. The device 100*h* shows the minimum number of (e.g., three) legs 104. Positioning the rear leg 104 right or left acts as a rudder changing the steering of the device 100*h*. Using a rear leg 104 made of a low friction material can increase the device's speed as previously described. The device 100*j* is three-legged device with the single leg 104 at the front. Steering can be adjusted on the rear legs by moving one forward of the other. The device 100*i* includes significantly altered rear legs 104 that make the device 100*i* appear more like a grasshopper. These legs 104 can function similar to legs 104 on the device 100*k*, where the middle legs 104*b* are raised and function only aesthetically until they work in self-righting the device 100*k* during a rollover situation.

In some implementations, devices 100 can include adjustment features, such as adjustable legs 104. For example, if a consumer purchases a set of devices 100 that all have the same style (e.g., an ant), the consumer may want to make some or all of the devices 100 move in varying ways. In some implementations, the consumer can lengthen or shorten individual leg 104 by first loosening a screw (or clip) that holds the leg 104 in place. The consumer can then slide the leg 104 up or down and retighten the screw (or clip). For example, referring for FIG. 3B, screws 310*a* and 310*b* can be loosened for repositioning legs 104*a* and 104*c*, and then tightened again when the legs are in the desired place.

In some implementations, screw-like threaded ends on leg bases 106*b* along with corresponding threaded holes in the device housing 102 can provide an adjustment mechanism for making the legs 104 longer or shorter. For example, by turning the front legs 104*a* to change the vertical position of the legs bases 106*b* (i.e., in the same way that turning a screw in a threaded hole changes the position of the screw), the consumer can change the length of the front legs 104*a*, thus altering the behavior of the device 100.

In some implementations, the leg base 106*b* ends of adjustable legs 104 can be mounted within holes in housing 102 of the device 100. The material (e.g., rubber) from which the legs are constructed along with the size and material of the holes in the housing 102 can provide sufficient friction to hold the legs 104 in position, while still allowing the legs to be pushed or pulled through the holes to new adjusted positions.

In some implementations, in addition to using adjustable legs 104, variations in movement can be achieved by slightly changing the CG, which can serve to alter the effect of the vibration of the motor 202. This can have the effect of making the device move slower or faster, as well as changing the device's tendency to turn. Providing the consumer with adjustment options can allow different devices 100 to move differently.

Device Dimensions

Figure 7A:
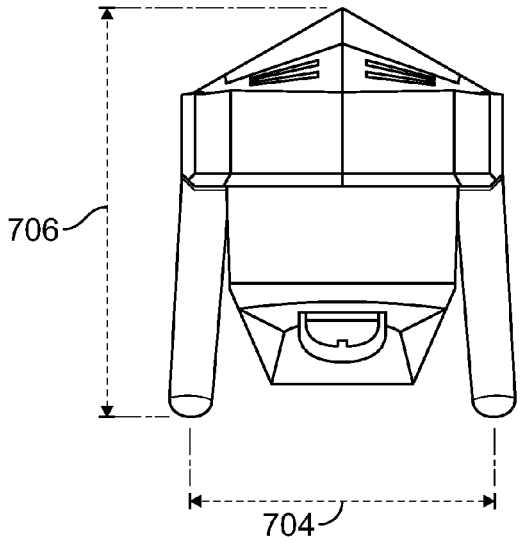
FIGS. 7A and 7B show example dimensions of the device.
Figure 7B:
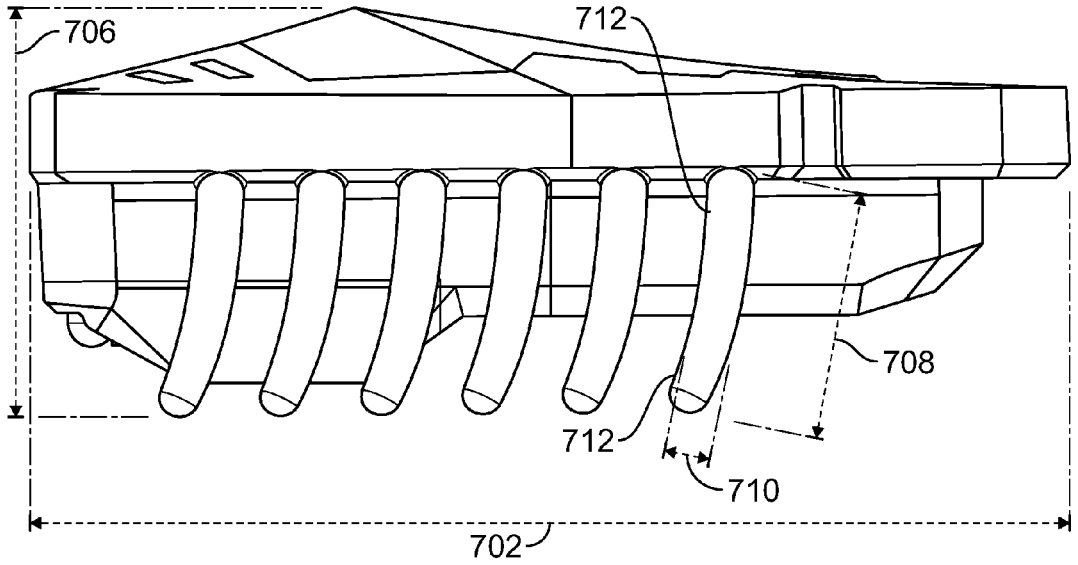

FIGS. 7A and 7B show example dimensions of the device 100. For example, a length 702 is approximately 1.73 inches, a width 704 from leg tip to leg tip is approximately 0.5 inches, and a height 706 is approximately 0.681 inches. A leg length 708 can be approximately 0.4 inches, and a leg diameter 710 can be approximately 0.077 inches. A radius of curvature (shown generally at 712) can be approximately 1.94 inches. Other dimensions can also be used. In general, the device length 702 can be in the range from two to five times the width 704 and the height 706 can be in the approximate range from one to two times the width 704. The leg length 708 can be in the range of three to ten times the leg diameter 710. There is no physical limit to the overall size that the device 100 can be scaled to, as long as motor and counterweight forces are scaled appropriately. In general, it may be beneficial to use dimensions substantially proportional to the illustrated dimensions. Such proportions may provide various benefits, including enhancing the ability of the device 100 to right itself after tipping and facilitating desirable movement characteristics (e.g., tendency to travel in a straight line, etc.).

Construction Materials

Material selection for the legs is based on several factors that affect performance. The materials main parameters are coefficient of friction (COF), flexibility and resilience. These parameters in combination with the shape and length of the leg affect speed and the ability to control the direction of the device.

COF can be significant in controlling the direction and movement of the device. The COF is generally high enough to provide resistance to sideways movement (e.g., drifting or floating) while the apparatus is moving forward. In particular, the COF of the leg tips (i.e., the portion of the legs that contact a support surface) can be sufficient to substantially eliminate drifting in a lateral direction (i.e., substantially perpendicular to the direction of movement) that might otherwise result from the vibration induced by the rotating eccentric load. The COF can also be high enough to avoid significant slipping to provide forward movement when $F_v$ is down and the legs provide a forward push. For example, as the legs bend toward the back of the device 100 (e.g., away from the direction of movement) due to the net downward force on the one or more driving legs (or other legs) induced by the rotation of the eccentric load, the COF is sufficient to prevent substantial slipping between the leg tip and the support surface. In another situation, the COF can be low enough to allow the legs to slide (if contacting the ground) back to their normal position when $F_v$ is positive. For example, the COF is sufficient low that, as the net forces on the device 100 tend to cause the device to hop, the resiliency of the legs 104 cause the legs to tend to return to a neutral position without inducing a sufficient force opposite the direction of movement to overcome either or both of a frictional force between one or more of the other legs (e.g., back legs 104*c*) in contact with the support surface or momentum of the device 100 resulting from the forward movement of the device 100. In some instances, the one or more driving legs 104*a* can leave (i.e., hop completely off) the support surface, which allows the driving legs to return to a neutral position without generating a backward frictional force. Nonetheless, the driving legs 104*a* may not leave the support surface every time the device 100 hops and/or the legs 104 may begin to slide forward before the legs leave the surface. In such cases, the legs 104 may move forward without causing a significant backward force that overcomes the forward momentum of the device 100.

Flexibility and resilience are generally selected to provide desired leg movement and hop. Flexibility of the leg can allow the legs to bend and compress when $F_v$ is down and the nose moves down. Resilience of the material can provide an ability to release the energy absorbed by bending and compression, increasing the forward movement speed. The material can also avoid plastic deformation while flexing.

Rubber is an example of one type of material that can meet these criteria, however, other materials (e.g., other elastomers) may a have similar properties.

Figure 8:
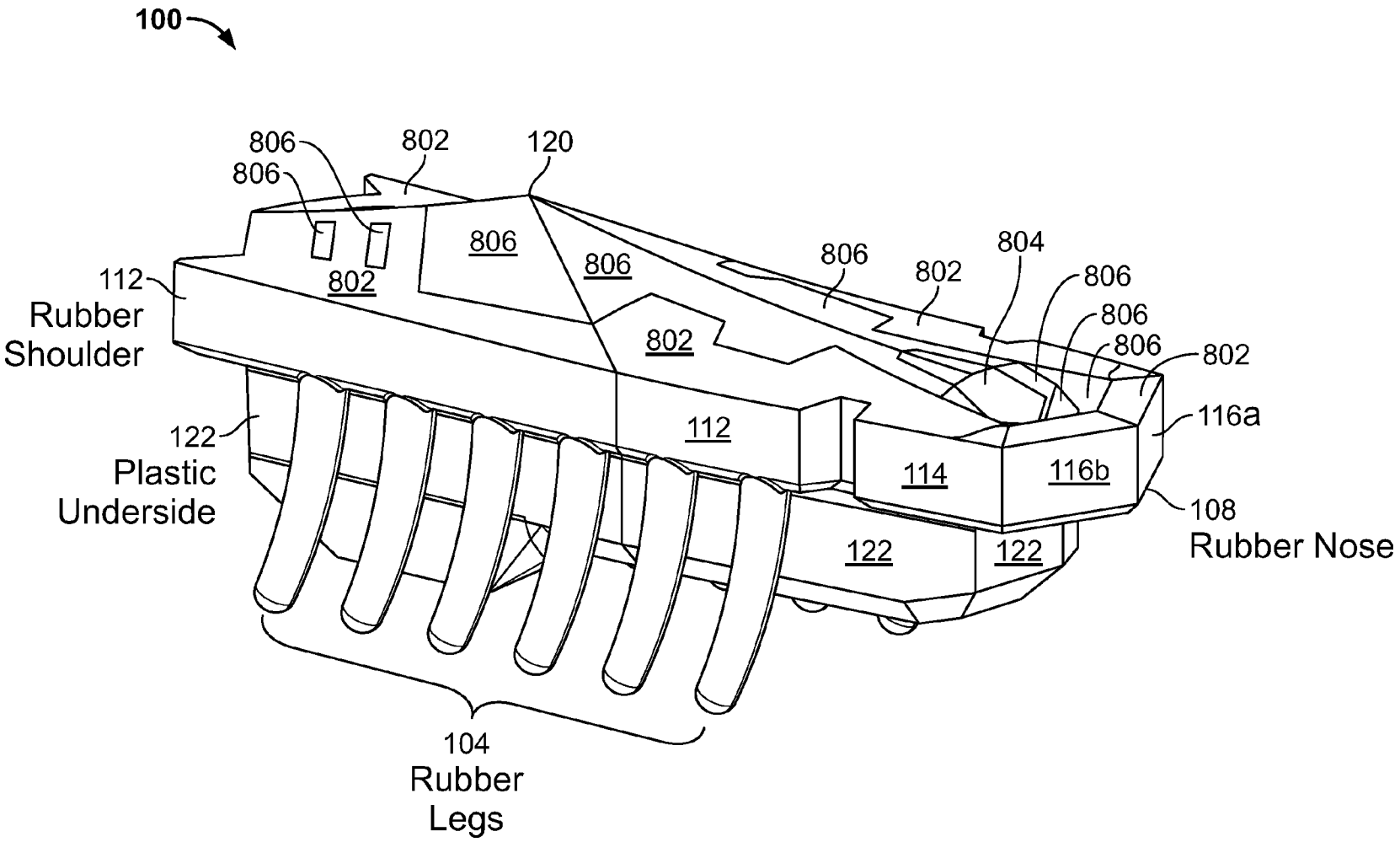
FIG. 8 shows one example configuration of example materials from which the device can be constructed.

FIG. 8 shows example materials that can be used for the device 100. In the example implementation of the device 100 shown in FIG. 8, the legs 104 are molded from rubber or another elastomer. The legs 104 can be injection molded such that multiple legs are integrally molded substantially simultaneously (e.g., as part of the same mold). The legs 104 can be part of a continuous or integral piece of rubber that also forms the nose 108 (including nose sides 116*a* and 116*b*), the body shoulder 112, and the head side surface 114. As shown, the integral piece of rubber extends above the body shoulder 112 and the head side surface 114 to regions 802, partially covering the top surface of the device 100. For example, the integral rubber portion of the device 100 can be formed and attached (i.e., co-molded during the manufacturing process) over a plastic top of the device 100, exposing areas of the top that are indicated by plastic regions 806, such that the body forms an integrally co-molded piece. The high point 120 is formed by the uppermost plastic regions 806. One or more rubber regions 804, separate from the continuous rubber piece that includes the legs 104, can cover portions of the plastic regions 806. In general, the rubber regions 802 and 804 can be a different color than plastic regions 806, which can provide a visually distinct look to the device 100. In some implementations, the patterns formed by the various regions 802-806 can form patterns that make the device look like a bug or other animate object. In some implementations, different patterns of materials and colors can be used to make the device 100 resemble different types of bugs or other objects. In some implementations, a tail (e.g., made of string) can be attached to the back end of the device 100 to make the device appear to be a small rodent.

The selection of materials used (e.g., elastomer, rubber, plastic, etc.) can have a significant effect on the vehicle's ability to self-right. For example, rubber legs 104 can bend inward when the device 100 is rolling during the time it is self-righting. Moreover, rubber legs 104 can have sufficient resiliency to bend during operation of the vehicle 100, including flexing in response to the motion of (and forces created by) the eccentric load rotated by the motor 202. Furthermore, the tips of the legs 104, also being made of rubber, can have a coefficient of friction that allows the driving legs (e.g., the front legs 104) to push against the surface 110 without significantly slipping.

Using rubber for the nose 108 and shoulder 112 can also help the device 100 to self-right. For example, a material such as rubber, having higher elasticity and resiliency than hard plastic, for example, can help the nose 108 and shoulder 112 bounce, which facilitates self righting, by reducing resistance to rolling while the device 100 is airborne. In one example, if the device 100 is placed on its side while the motor 202 is running, and if the motor 202 and eccentric load are positioned near the nose 108, the rubber surfaces of the nose 108 and shoulder 112 can cause at least the nose of the device 100 to bounce and lead to self-righting of the device 100.

In some implementations, the one or more rear legs 104*c* can have a different coefficient of friction than that of the front legs 104*a*. For example, the legs 104 in general can be made of different materials and can be attached to the device 100 as different pieces. In some implementations, the rear legs 104*c* can be part of a single molded rubber piece that includes all of the legs 104, and the rear legs 104*c* can be altered (e.g., dipped in a coating) to change their coefficient of friction.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Other alternative embodiments can also be implemented. For example, some implementations of the device 100 can omit the use of rubber. Some implementations of the device 100 can include components (e.g., made of plastic) that include glow-in-the-dark qualities so that the device 100 can be seen in a darkened room as it moves across the surface 110 (e.g., a kitchen floor). Some implementations of the device 100 can include a light (e.g., an LED bulb) that blinks intermittently as the device 100 travels across the surface 110.

Thus, particular embodiments of the subject matter have been described. Other embodiments are within the scope of the following claims.

What is claimed is:

1. An apparatus comprising:

a housing;

a vibration drive situated within the housing, wherein the vibration drive includes an eccentric load and a rotational motor adapted to rotate the eccentric load;

a battery situated within the housing;

a switch adapted to selectively connect the battery to the vibration drive;

a plurality of legs each having a leg base and a leg tip at a distal end relative to the leg base, wherein the legs are coupled to the housing at the leg base and include at least one driving leg constructed from a flexible material and having a leg base arranged farther forward relative to the leg tip;

wherein the vibration drive generates a force that is directed downward and is suitable to deflect the at least one driving leg to cause the apparatus to move in a substantially forward direction generally defined by an offset between the leg base and the leg tip as the rotational motor rotates the eccentric load; and wherein the at least one driving leg has an average axial cross-section of at least five percent of a length of the at least one driving leg between the leg base and the leg tip.

2. The apparatus of claim 1 wherein the flexible material includes rubber.

3. The apparatus of claim 1 wherein the flexible material includes an elastomer.

4. The apparatus of claim 1 wherein the at least one driving leg is configured to cause the apparatus to repeatedly hop as the rotational motor rotates the eccentric load.

5. The apparatus of claim 4 wherein the at least one driving leg is curved between the leg base and the leg tip.

6. The apparatus of claim 5 wherein the eccentric load is configured to be located toward a front end of the apparatus relative to the at least one driving leg, wherein the front end of the apparatus is defined by an end in the direction of movement.

7. The apparatus of claim 5 wherein the repeated hopping causes the apparatus to move in the direction generally defined by an offset between the leg base and the leg tip of the at least one driving leg.

8. The apparatus of claim 7 wherein the plurality of legs include at least two legs adapted to cause the apparatus to move.

9. The apparatus of claim 7 wherein at least one of the plurality of legs is adapted to drag and the leg tip of the at least one leg adapted to drag has a lower coefficient of friction than the at least one driving leg.

10. The apparatus of claim 7 wherein at least one of the plurality of legs is adapted to drag and the at least one leg that is adapted to drag is configured to have a lesser stiffness than the at least one driving leg.

11. The apparatus of claim 1 wherein the at least one driving leg includes a durometer in the range of approximately 55-75, based on the Shore A scale.

12. The apparatus of claim 5 wherein the eccentric load includes an inertial load adapted, when the eccentric load is rotated by the rotational motor, to cause the at least one driving leg to hop off a flat support surface.

13. The apparatus of claim 12 wherein the plurality of legs are adapted to allow the apparatus to turn when the at least one driving leg hops off a flat support surface.

14. The apparatus of claim 1 wherein the at least one driving leg is constructed from polystyrene-butadiene-styrene.

15. The apparatus of claim 1 wherein the at least one driving leg has a ratio of a leg length to a leg diameter in the range of 2.0 to 10.0.

16. The apparatus of claim 1 where a thickness of the legs is defined by a diameter of approximately 5.25 times less than the length of the leg.

17. The apparatus of claim 1 wherein a curvature of at least one of the legs is adapted to enhance a tendency of the apparatus to move in the direction generally defined by the offset between the leg base and the leg tip of the at least one of the legs.

18. The apparatus of claim 17 wherein the curvature of the at least one of the legs in combination with a resiliency of the at least one of the legs are adapted to allow the legs to maintain an approximately neutral position when the rotational motor is not rotating the eccentric load and to bend in a direction of the curvature when a rotational movement of the eccentric load introduces a downward force on the apparatus.

19. The apparatus of claim 18 wherein the neutral position is defined by a shape of the legs when not supporting a load.

20. The apparatus of claim 1 wherein at least one driving leg has a ratio of radius of curvature to leg length in a range of 2.5 to 20.

21. The apparatus of claim 20 where the curvature of the at least one driving leg is approximately consistent from the leg base to the leg tip.

22. The apparatus of claim 20 where the curvature of the at least one driving leg is defined by a radius of curvature of approximately 3 to 6 times the length of the leg.

23. The apparatus of claim 1 wherein a relative stiffness of at least two specific legs of the plurality of legs is configured to alter a tendency of the apparatus to turn.

24. The apparatus of claim 1 wherein the plurality of legs are arranged in two rows, with each row having at least two legs, the leg base of the legs in each row being aligned substantially abutting each lateral side of the housing.

25. The apparatus of claim 1 wherein the plurality of legs are arranged in two rows, with each row having at least four legs, the leg base of the legs in each row being aligned substantially abutting each lateral side of the housing.

26. The apparatus of claim 1 wherein the plurality of legs are arranged in two rows, with each row having at least six legs, the leg base of the legs in each row being aligned substantially abutting each lateral side of the housing.

27. The apparatus of claim 24 wherein at least one of the legs in a first one of the rows is longitudinally offset from a corresponding leg in a second one of the rows to alter a tendency of the apparatus to turn as a result of a rotation of the eccentric load.

28. The apparatus of claim 1 wherein a lateral distance between the eccentric load and the leg tip of the at least one driving leg is within a range of 50-150% of a length of the at least one driving leg.

29. The apparatus of claim 1, wherein one or more of the plurality of legs is adjustable.

30. The apparatus of claim 29, wherein each of the one or more adjustable legs is mounted within a corresponding hole in the housing.

31. The apparatus of claim 30 wherein each of the one or more adjustable legs is frictionally held in position in the corresponding hole in the housing.

32. The apparatus of claim 1, wherein at least one of the legs is adjustable, the housing includes a hole corresponding to each of the adjustable legs, and wherein the at least one adjustable leg is frictionally received within the corresponding hole.

33. The apparatus of claim 1, wherein the housing includes at least one opening corresponding to at least one of the legs, the at least one of the legs being frictionally received within the opening.

34. An apparatus comprising:

a housing;

a vibration drive situated within the housing, wherein the vibration drive includes an eccentric load and a rotational motor adapted to rotate the eccentric load;

a battery situated within the housing;

a switch adapted to selectively connect the battery to the vibration drive;

a plurality of legs arranged in two rows and adapted to contact a supporting surface, each of the legs having a leg base and a leg tip at a distal end relative to the leg base, including at least one driving leg constructed from a flexible material;

wherein as the vibration drive generates a force that is directed downward and is suitable to deflect the at least one driving leg, the at least one driving leg tends to return to a neutral position to cause the apparatus to move in a substantially forward direction;

wherein the at least one driving leg has an average axial cross-section of at least five percent of a length of the at least one driving leg between the leg base and the leg tip; and wherein at least a portion of the housing is situated between the two rows of legs and extends below the leg base of the plurality of legs.

35. The apparatus of claim 34 wherein the plurality of legs include at least one leg adapted to drag.

36. The apparatus of claim 34 wherein the flexible material comprises an elastomer.

37. The apparatus of claim 34 wherein the flexible material comprises rubber.

38. The apparatus of claim 34 wherein the legs are integrally molded to a portion of the housing at the leg base.

39. The apparatus of claim 34 wherein the at least one driving leg is configured to cause the apparatus to repeatedly hop as the rotational motor rotates the eccentric load.

40. The apparatus of claim 39 wherein the at least one driving leg is curved between the leg base and the leg tip.

41. The apparatus of claim 40 wherein the eccentric load is configured to be located toward a front end of the apparatus relative to the at least one driving leg, wherein the front end of the apparatus is defined by an end in the direction of movement.

42. The apparatus of claim 40 wherein the repeated hopping causes the apparatus to move in the direction generally defined by an offset between the leg base and the leg tip of the at least one driving leg.

43. The apparatus of claim 34 wherein the at least one driving leg is constructed from polystyrene-butadiene-styrene.

44. The apparatus of claim 34 wherein a resiliency of the at least one driving leg is adapted to allow the at least one driving leg to maintain an approximately neutral position when the rotational motor is not rotating the eccentric load and to bend when a rotational movement of the eccentric load introduces a downward force on the apparatus.

45. The apparatus of claim 34 wherein the leg base of the legs in each row is aligned substantially about each lateral side of the housing.

46. The apparatus of claim 34 wherein a lateral distance between the eccentric load and the leg tip of the at least one driving leg is within a range of 50-150% of a length of the at least one driving leg.

47. The apparatus of claim 34, wherein one or more of the plurality of legs is adjustable.

48. The apparatus of claim 47 wherein each of the one or more adjustable legs is mounted within a corresponding hole in the housing.

49. The apparatus of claim 48 wherein each of the one or more adjustable legs is frictionally held in position in the corresponding hole in the housing.

50. The apparatus of claim 34, wherein at least one of the legs is adjustable, the housing includes a hole corresponding to each of the adjustable legs, and wherein the at least one adjustable leg is frictionally received within the corresponding hole.

51. The apparatus of claim 34, wherein the housing includes at least one opening corresponding to at least one of the legs, the at least one of the legs being frictionally received within the opening.

52. An apparatus comprising:

a housing;

a vibration drive situated within the housing, wherein the vibration drive includes an eccentric load and a rotational motor adapted to rotate the eccentric load;

a battery situated within the housing;

a switch adapted to selectively connect the battery to the vibration drive;

a plurality of legs arranged in two rows and adapted to contact a support surface, each of the legs having a leg base and a leg tip at a distal end relative to the leg base, wherein the legs are coupled to the housing at the leg base and include at least one driving leg configured to cause the apparatus to move in a forward direction generally defined by an offset between the leg base and the leg tip as the rotational motor rotates the eccentric load, wherein the at least one driving leg is constructed from a flexible material with an average axial cross-section of at least five percent of a length of the at least one driving leg between the leg base and the leg tip and is configured to:

tend to bend, in a direction opposite the direction of movement, without substantial slippage on the support surface when a net downward force exists between the at least one driving leg and the support surface; and tend to return to a neutral position without inducing a sufficient force opposite the direction of movement to overcome a momentum in the forward direction.

53. The apparatus of claim 52 wherein the at least one driving leg is configured to cause the apparatus to repeatedly hop as the rotational motor rotates the eccentric load.

54. The apparatus of claim 52 wherein the at least one driving leg is constructed from polystyrene-butadiene-styrene.

55. The apparatus of claim 52 wherein a lateral distance between the eccentric load and the leg tip of the at least one driving leg is within a range of 50-150% of a length of the at least one driving leg.

56. The apparatus of claim 52, wherein one or more of the plurality of legs is adjustable.

57. The apparatus of claim 56 wherein each of the one or more adjustable legs is mounted within a corresponding hole in the housing.

58. The apparatus of claim 57 wherein each of the one or more adjustable legs is frictionally held in position in the corresponding hole in the housing.

59. The apparatus of claim 52, wherein at least one of the legs is adjustable, the housing includes a hole corresponding to each of the adjustable legs, and wherein the at least one adjustable leg is frictionally received within the corresponding hole.

60. The apparatus of claim 52, wherein the housing includes at least one opening corresponding to at least one of the legs, the at least one of the legs being frictionally received within the opening.

61. An apparatus comprising:

a housing;

a rotational motor situated within the housing;

an eccentric load, wherein the rotational motor is adapted to rotate the eccentric load;

a plurality of legs each having a leg base and a leg tip at a distal end relative to the leg base, wherein at least a portion of the plurality of legs are:

constructed from a flexible material; and include at least one driving leg configured to cause the apparatus to move in a direction generally defined by an offset between the leg base and the leg tip as the rotational motor rotates the eccentric load; and wherein each of the plurality of legs has an average axial cross-section of at least five percent of a length of the leg between the leg base and the leg tip and forces from rotation of the eccentric load interact with a resilient characteristic of the at least one driving leg to cause the at least one driving leg to propel the apparatus in a forward direction and to leave a support surface as the apparatus translates in the forward direction, and wherein the legs are arranged in two single file rows, with the leg base of the legs in each row coupled to the housing substantially about a lateral edge of the housing and wherein at least a portion of the housing is situated between the two rows of legs and extends below the leg base of the plurality of legs in the direction of the leg tip of the plurality of legs.

62. The apparatus of claim 61 wherein the plurality of legs include multiple leg pairs, with each leg pair including a first leg coupled to the housing substantially along a first lateral edge of the housing and a second leg coupled to the housing substantially along a second lateral edge, substantially opposite the first lateral edge, of the housing, and the first leg for at least one leg pair includes different drag characteristics than the second leg for the at least one leg pair, with the different drag characteristics configured to counteract a tendency of the apparatus to turn as a result of a rotation of the eccentric load, and wherein the first leg and the second leg for the at least one leg pair are situated substantially equal distances from a center of gravity of the apparatus.

63. The apparatus of claim 61 wherein the legs are arranged in a first row and a second row, with each row arranged substantially parallel to a longitudinal axis of the housing and with each leg in the first row having a corresponding leg in the second row, and at least one of the legs in the first row that contacts a supporting surface as rotation of the eccentric load induces movement of the apparatus is longitudinally offset from a corresponding leg in the second row that contacts a supporting surface as rotation of the eccentric load induces movement of the apparatus, wherein the longitudinal offset alters a tendency of the apparatus to turn as rotation of the eccentric load induces movement of the apparatus.

64. The apparatus of claim 61 wherein the rotational motor has an axis of rotation that is substantially parallel to the support surface on which the leg tips of the plurality of legs are resting in a neutral position and the axis of rotation passes within 20% of a center of gravity of the apparatus as a percentage of the height of the apparatus to induce a substantially constant rolling force.

65. The apparatus of claim 64 wherein the housing is configured to facilitate rolling of the apparatus about a longitudinal center of gravity, based on a rotation of the eccentric load, with the apparatus on a substantially flat surface when the legs are not oriented such that a leg tip of at least one leg on each lateral side of the housing contacts the substantially flat surface.

66. The apparatus of claim 65 wherein the plurality of legs are arranged in two rows and the rows are substantially parallel to the axis of rotation of the rotational motor, and wherein at least some of the leg tips that contact the substantially flat surface tend to substantially prevent rolling of the apparatus based on a spacing of the two rows of legs when the legs are oriented such that a leg tip of at least one leg on each lateral side of the housing contacts the substantially flat surface.

67. The apparatus of claim 61 wherein an axis of rotation of the rotational motor passes sufficiently close to a longitudinal center of gravity of the apparatus to induce a substantially constant tendency for the apparatus to roll about the longitudinal center of gravity and the housing is configured to facilitate rolling of the apparatus about the longitudinal center of gravity, with the substantially constant tendency for the apparatus to roll and the configuration of the housing to facilitate rolling about the longitudinal center of gravity enabling the apparatus to roll onto the legs based on forces from rotation of the eccentric load.

68. The apparatus of claim 61 wherein the housing includes a front end, rear end, top side, bottom side, and lateral sides, wherein the front end includes a resilient nose adapted to contact obstacles and having a resiliency adapted to facilitate bouncing off of obstacles and causing the apparatus to deflect off of obstacles at an angle as the apparatus moves in the forward direction.

69. The apparatus of claim 61 wherein a coefficient of friction of a portion of at least a subset of the legs that contact a support surface is sufficient to substantially eliminate drifting in a lateral direction.

70. The apparatus of claim 61 wherein fewer than twenty legs contact a support surface as the at least one driving leg causes the apparatus to move.

71. The apparatus of claim 61 wherein the legs are sufficiently stiff that four or fewer legs are capable of supporting the apparatus without substantial deformation when the apparatus is in an upright position.

72. The apparatus of claim 61 wherein the plurality of legs include a plurality of driving legs arranged in at least one pair and the eccentric load is configured to be located closer to a front end of the apparatus than a forward-most pair of driving legs, wherein the front end of the apparatus is defined by an end in a direction that the apparatus primarily tends to move as the rotational motor rotates the eccentric load.

73. The apparatus of claim 61 wherein the plurality of legs are integrally molded with at least a portion of the body.

74. The apparatus of claim 61 wherein the plurality of legs are co-molded with at least a portion of the housing constructed from a different material.

75. The apparatus of claim 61 wherein at least a subset of the plurality of legs, including the at least one driving leg, are curved and are arranged in a row, and a ratio of a radius of curvature of the curved legs to leg length of the curved legs is in a range of 2.5 to 20.

76. The apparatus of claim 61 wherein the flexible material includes an elastomer.

77. The apparatus of claim 61, wherein one or more of legs is adjustable.

78. The apparatus of claim 77, wherein each of the one or more adjustable legs is mounted within a corresponding hole in the housing.

79. The apparatus of claim 78 wherein each of the one or more adjustable legs is frictionally held in position in the corresponding hole in the housing.

80. The apparatus of claim 61, wherein at least one of the legs is adjustable, the housing includes a hole corresponding to each of the adjustable legs, and wherein the at least one adjustable leg is frictionally received within the corresponding hole.

81. The apparatus of claim 61, wherein the housing includes at least one opening corresponding to at least one of the legs, the at least one of the legs being frictionally received within the opening.

* * * * *